US007246475B2

(12) United States Patent
Bauer

(10) Patent No.: US 7,246,475 B2
(45) Date of Patent: Jul. 24, 2007

(54) METHOD AND SYSTEM FOR DETACHABLY FIXING A PLANAR COMPONENT TO A SUB-SURFACE

(75) Inventor: Jörg R. Bauer, Gablerstrasse 4, 88250 Weingarten (DE)

(73) Assignee: Jorg R. Bauer, Weingarten (DE)

( * ) Notice: Subject to any disclaimer, the term of this patent is extended or adjusted under 35 U.S.C. 154(b) by 274 days.

(21) Appl. No.: 10/380,034

(22) PCT Filed: Sep. 14, 2001

(86) PCT No.: PCT/EP01/10627

§ 371 (c)(1),
(2), (4) Date: Mar. 10, 2003

(87) PCT Pub. No.: WO02/22986

PCT Pub. Date: Mar. 21, 2002

(65) Prior Publication Data

US 2005/0072083 A1 Apr. 7, 2005

(30) Foreign Application Priority Data

Sep. 15, 2000 (DE) ..... 100 45 823
Oct. 19, 2000 (DE) ..... 100 51 887
Apr. 18, 2001 (DE) ..... 101 19 057

(51) Int. Cl.
*E04F 13/08* (2006.01)

(52) U.S. Cl. ..... 52/747.11; 442/230

(58) Field of Classification Search ..... 52/741.1, 52/747.11, 506.01, 506.05, 746.1; 4/538, 4/584, 592; 442/230, 232, 236, 320, 378, 442/379; 428/457, 458, 461, 464
See application file for complete search history.

(56) References Cited

U.S. PATENT DOCUMENTS 3,102,314 A * 9/1963 Alderfer ..... 24/303

(Continued)

FOREIGN PATENT DOCUMENTS

DE 1 926 226 11/1970

(Continued)

*Primary Examiner*—Carl D. Friedman
*Assistant Examiner*—Steven Marsh
(74) *Attorney, Agent, or Firm*—Michael Best & Friedrich LLP

(57) ABSTRACT

The invention relates to a system for detachably fixing a surface component (16) to a background (18), especially a tile to a wall or on a bottom, whereby projections connected to the surface component when secured to the background and/or recesses engage with recesses connected to the background and/or projections, said recesses and projections being correspondingly embodied in such a way that they have deformable undercuts in the direction of the distance of said component from the background, the projections and recesses connected to the background being embodied on a forming film (4). The projections and recesses embodied on the surface component (4) are formed by a hardenable bonding material (22) which is applied to the forming film (4) joined to the background (18, 26) and/or to the surface component before it is pressed onto the forming film, said material bonding with the surface component when hardened.

18 Claims, 17 Drawing Sheets

U.S. PATENT DOCUMENTS

| | | | | | |
|---|---|---|---|---|---|
| 4,025,159 | A * | 5/1977 | McGrath | 359/514 |
| 5,255,482 | A * | 10/1993 | Whitacre | 52/390 |
| 5,502,931 | A * | 4/1996 | Munir | 52/144 |
| 5,860,267 | A * | 1/1999 | Pervan | 52/748.1 |
| 5,927,033 | A * | 7/1999 | Kreckl | 52/390 |
| 6,023,907 | A * | 2/2000 | Pervan | 52/748.1 |
| 6,176,065 | B1 * | 1/2001 | Honda | 52/783.18 |
| 6,261,394 | B1 * | 7/2001 | Raineri | 156/63 |
| 6,286,279 | B1 * | 9/2001 | Bean et al. | 52/390 |
| 6,612,091 | B1 * | 9/2003 | Glover et al. | 52/786.1 |
| 6,739,097 | B1 * | 5/2004 | Rodin | 52/71 |

FOREIGN PATENT DOCUMENTS

| | | |
|---|---|---|
| DE | 25 52 134 | 5/1977 |
| DE | 40 26 472 | 7/1997 |
| EP | 0 969 162 | 6/1999 |
| EP | 0 969 162 | 1/2000 |
| WO | WO 01 69007 | 9/2001 |

* cited by examiner

FIG 8
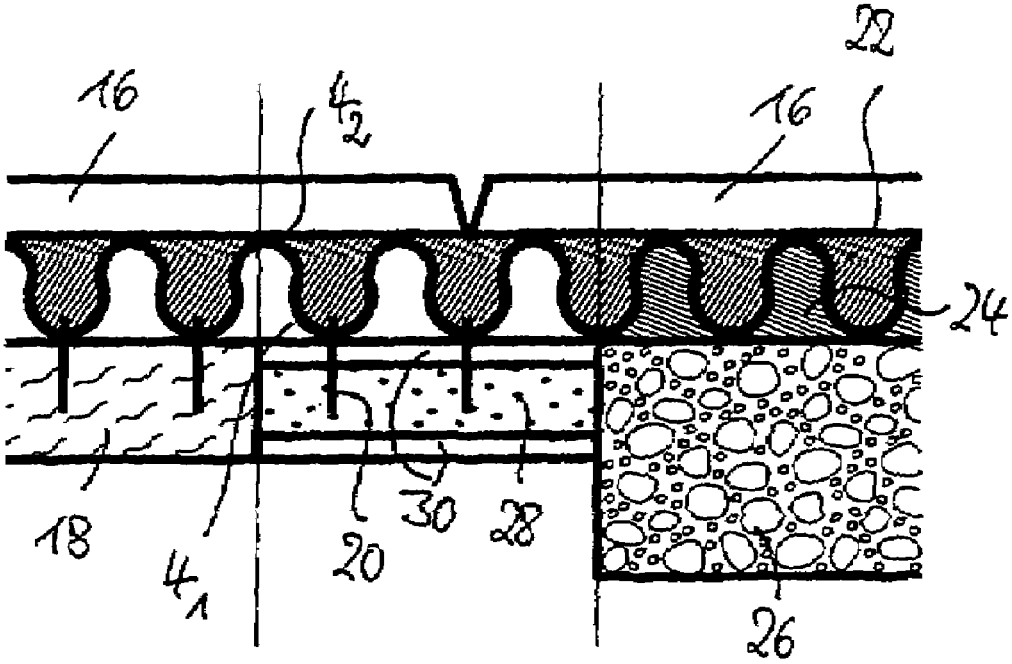
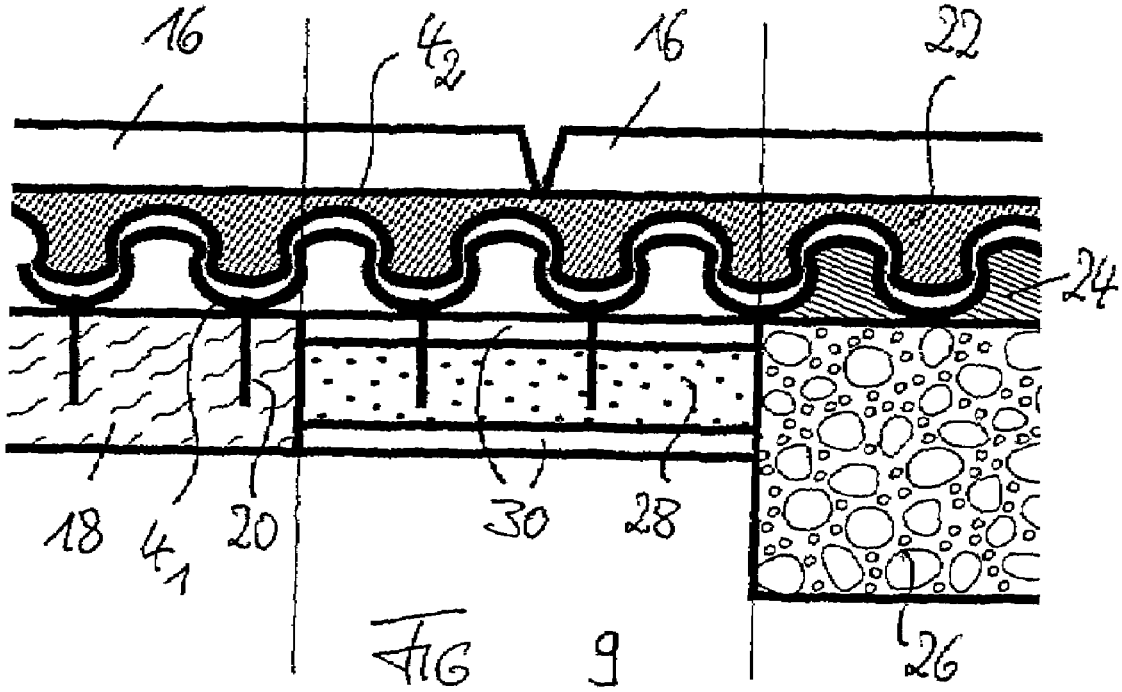
FIG 9

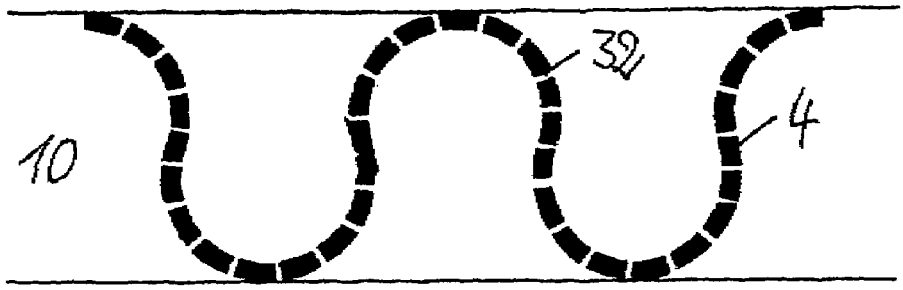
FIG 10
FIG 11
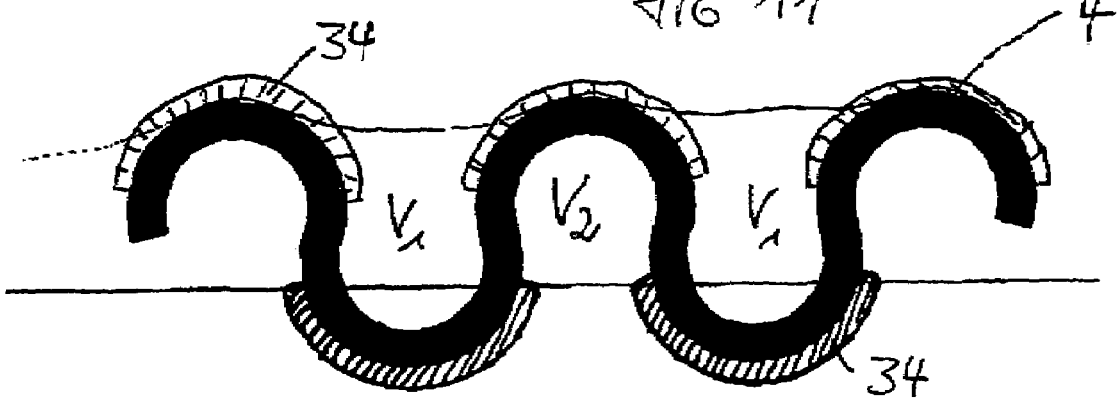
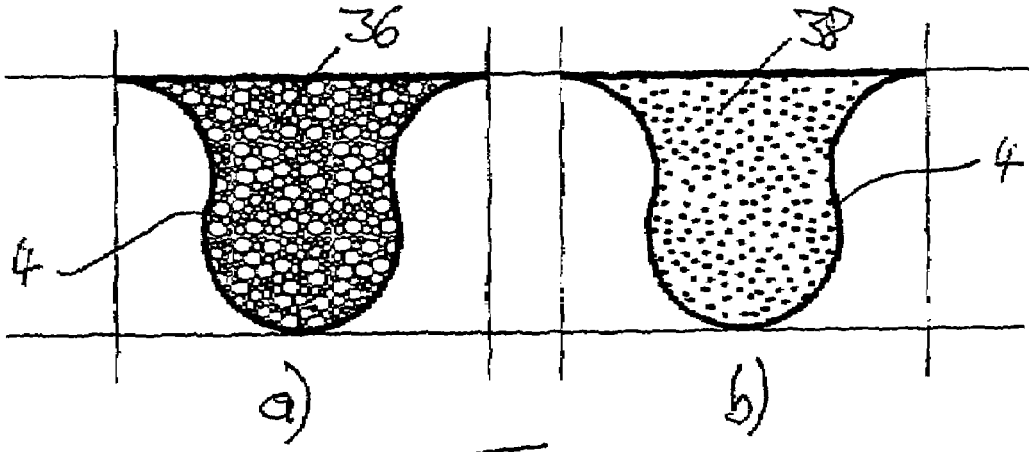
FIG 12 a)
b)
c)
d)
e)
f)
4
86
88
90
92
94
96

METHOD AND SYSTEM FOR DETACHABLY FIXING A PLANAR COMPONENT TO A SUB-SURFACE

CROSS-REFERENCE

This application is the US national stage filing of International application no. PCT/EP01/10627 filed Sep. 14, 2001, which claims priority to German patent application nos. 100 45 823.8 filed Sep. 15, 2000, 100 51 887.8 filed Oct. 19, 2000 and 101 19 057.3 filed Apr. 18, 2001.

TECHNICAL FIELD

The invention relates to a method and a system for detachably fixing a planar component to a sub-surface, in particular a tile to a wall or to a floor. Furthermore, the invention relates to a shaped foil, a connection component, a plate component, a connecting element, a spacer component, a fastening element, a plug connector, a tub body and a corner connector.

BACKGROUND ART

The installation of tiles, floor boards, etc. is associated with much time and effort on the one hand, and leaves many problems unresolved on the other hand. For example, it is possible only with much difficulty to obtain a reliable seal between the surface of the tiles and the sub-surface with the connecting materials currently in use, such as mortar, adhesive etc. Furthermore, tile or plate elements can be removed from the sub-surface only with substantial time and effort. The removal of plate elements from the sub-surface is necessary, for example, when tiles or floor boards need to be replaced in showroom kitchens, when tiles or floor boards have to be replaced in a residential house, etc.

A method of fixing panels to a sub-surface is known from DE 40 26 472 C2. In connection with such fastening, a plastic layer with elevations and/or recesses is applied to the backsides of the panels, and a coating with recesses and/or elevations is provided on the sub-surface, whereby the elevations and/or recesses of the coating correspond with those of the plastic layer in such a way that they clamp together, so that the panels can be press-fit onto the coating layer of the sub-surface and are securable thereon in a form-fit manner. The coating layer that can be secured on the sub-surface is formed, for example, by means of a shaped foil made of polypropylene or ABS that, for example, can be nailed to the sub-surface. The elevations and/or recesses may be configured in such a manner that they easily engage each other by means of undercuts. A characteristic feature of the known type of fastening is that the panels have to be individually provided with the plastic layer, which is expensive. Furthermore, it is not possible to re-position the panels pressed onto the sub-surface due to the engagement between the recesses and the elevations, which are arranged in a grid-like configuration, so that it is not possible, for example, to compensate for tolerances existing between tiles.

A similar detachable fixing of tiles to a sub-surface is known from DE OS 1 926 226, where the sub-surface and the backsides of the tiles are each provided with a profiled support plate, whereby the profiled support plates are provided with projections and recesses that engage each other in a locking manner with an undercut and can be elastically deformed, so that they are detachable.

SUMMARY OF THE INVENTION

The invention has the object of providing a practical and lower cost solution to the problem of detachably securing planar components on a sub-surface, in particular tiles on a wall or on a floor.

A first solution of the inventive object is achieved with one or more of the appended method claims.

According to the inventive method, tiles can be laid in the following respect according to the conventional manner, namely a connecting material, for example a tile adhesive, is applied to the sub-surface that is provided with the shaped foil and/or to the backside of the tile, and the tile is subsequently pressed onto the sub-surface, wherein the tile can be re-positioned, for example for the purpose of compensating for tolerances with other tiles, as long as the connecting material has not yet hardened. After the connecting material has hardened, the tile is retained on the shaped foil in a form-fit manner by means of the hardened connecting material connected with the tile. The tile itself can be manufactured in the entirely conventional manner and need not be provided with any shaped components before it is laid. By employing a thick-walled, elastic shaped foil, the tile can be detached by elastic deformation of the shaped foil, wherein the projections and recesses formed by the connecting material on the tile can be preserved or destroyed. Alternatively, the tile may be detached by peeling off the shaped foil, which shaped foil preferably does not bond with the connecting material. The shaped foil can be directly fixed to a sub-surface mechanically, for example by stapling it to the sub-surface, or it may be secured by applying to the sub-surface a hardening connecting material, into which the shaped foil is pressed, wherein the hardening connecting material bonds with the sub-surface and a form-fit connection is produced between the sub-surface and the shaped foil by the hardened connecting material received in the recesses of the shaped foil facing the sub-surface.

The method also may be implemented with a two-layer shaped foil, whereby a particularly simple detachment of the tiles is appropriate, after which the sub-surface is then immediately available again for installing new tiles.

Another solution of the inventive object is achieved with the systems according to the appended claims.

In addition, shaped foils are advantageously employed with the inventive method and for the inventive system.

Moreover, different components also can be used in the inventive method and system.

The invention can be applied in a great variety of different ways. The invention is suited in a particularly beneficial manner for the construction trade, in particular for installing tiles, floor boards or other planar elements on floors, ceilings and walls. In the present context, the term "planar component" in particular relates to those components that comprise a surface for attachment to a sub-surface. The term "sub-surface" must not necessarily directly relate to a wall, a floor or a ceiling, but may also relate to an intermediate layer to which the planar component should be fixed.

BRIEF DESCRIPTION OF THE DRAWINGS

The invention is explained in further detail in the following with the help of schematic drawings, in which:

FIG. 8 is a cross section through plate elements fixed to different sub-surfaces, using two shaped foils according to FIG. 3.

FIG. 9 is a cross section similar to FIG. 8, using two foil pieces according to FIG. 7.

FIG. 10 is a shaped foil with ventilation apertures.

FIG. 11 is a shaped foil with thickenings for enlarging the form-fit connection.

FIG. 12 shows shaped foils filled with different materials.

DETAILED DESCRIPTION OF THE INVENTION

Figure 1:
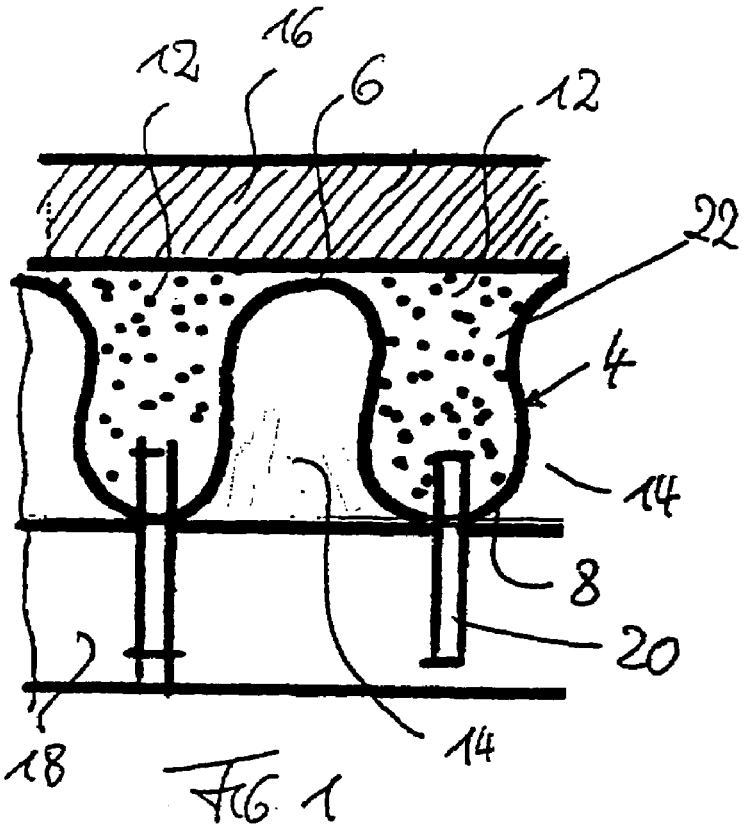
FIG. 1 is a cross section through a system in which a plate element is fixed to a wooden sub-surface according to the invention.

FIG. 1 schematically shows how a plate element, for example a tile, is fixed to a sub-surface. A shaped foil, which is denoted by 4 as a whole, is an important element of the connection system shown in FIG. 1. This shaped foil has a sinusoidal-shaped cross section and comprises in cross-section grooves and projections 6 and 8 on each of its two sides, wherein recesses 12 and 14 are respectively formed between the projections 6 and 8. As is evident from the figures, the wall areas separating the projections from the recesses do not extend perpendicularly to the longitudinal direction of the foil, but rather are curved outwards, so that neighboring recesses 12 and 14 undercut each other when viewing the foil from the top; i.e. said recesses are formed in such a manner that they are in a mutual form-fit perpendicular to the longitudinal direction of the foil with respect to an assumed relative movement. In other words, starting from the bottom of the recess, the cross-sectional area of a recess first increases as the spacing from the recess increases, then decreases, and then increases again. The shaped foil 4 is formed from a material and with a thickness in such a manner that it exhibits a certain inherent stiffness, i.e. it retains the shown form in its free condition. The shaped foil may consist of, for example, a thermoplastic material.

The plate element 16, for example a wall tile, is fixed to a sub-surface 18 in the following manner:

In FIG. 1, the sub-surface is a wooden panel 18 (or, for example a plaster board) that may be, for example, a section of a floor or, in an embodiment rotated by 90°, of a wall (or, with another rotation by 90°, of a ceiling). The shaped foil 4 is fixed to the wooden panel 18 by means of stapling by inserting, in a well-known manner, wire fasteners in the deepest points of the recesses 12 and penetrating through the shaped foil 4 into the wooden panel 18. Thereafter, the connecting material 22, for example tile adhesive or tile mortar, is filled in the recesses 12 of the inherently stiff shaped foil 4, and the plate element 16 is pressed on and moved into the desired position. During hardening, the connecting material 22 bonds with the backside of the plate element 16, so that the plate element 16 is connected with the wooden panel 18 via the form-fit between the hardened connecting material 22 and the shaped foil 4 without the shaped foil 4 adhering to or otherwise bonding with the connecting material 22. It is understood that the connecting material also can be applied to the tile to be laid and, according to this application of the shaped foil, the connecting material is pressed into the foil's recesses. In the manner described above, it is possible to cover the surface of a wall with plate elements, whereby the latter can be exactly aligned with each other as long as the connecting material has not yet hardened, so that the tolerances of the plate elements can be compensated.

For detaching the plate element 16 from the wooden panel 18, the shaped foil 4 according to FIG. 1 is pulled, for example to the left, whereby it is stretched, so that the form-fit connection is released and the shaped foil is torn from the wire fasteners or is torn out together with the wire fasteners. In this way, the plate elements can be removed from the substrate in a simple manner without damaging the substrate. New plate elements can be subsequently fixed to the substrate according to the described method. The assembly can be additionally stabilized by, prior to the stapling step, filling a hardenable material in the recesses 14 as well, which hardenable material does not necessarily have to bond with the wood material or the plaster.

Figure 2:
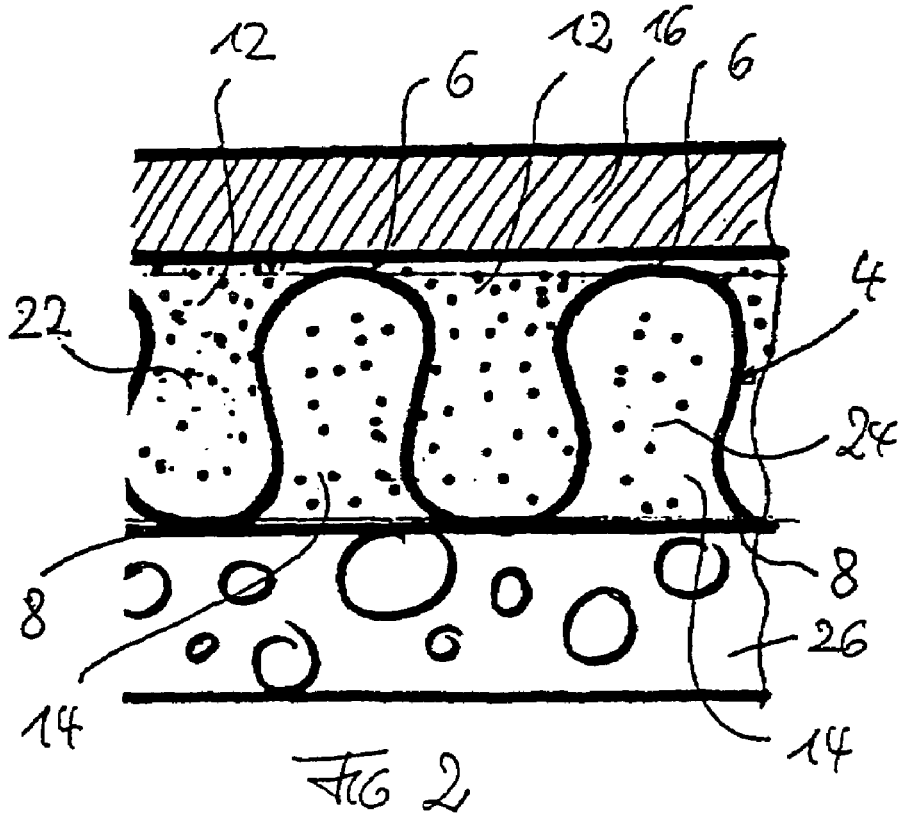
FIG. 2 is a cross section through a system in which a plate element is fixed to a brick wall.

In connection with the assembly according to FIG. 2, which basically corresponds with the one shown in FIG. 1, wherein the sub-surface, however, is a brickwork or a coat of plaster, a connecting material 24 is first applied to the sub-surface 26 and bonds with the latter as it is hardening. The shaped foil 4 is pressed into the still-unhardened connecting material 24. The layer thickness of the connecting material 24 is dimensioned in such a manner that the recesses 14 of the shaped foil 4 are filled as the latter is being pressed in. Thereafter, in the manner described in connection with FIG. 1, the connecting material 22 is filled in the recesses 12 of the shaped foil that is fixed to the sub-surface 26 via the form-fit connection between the connecting material 24 present in the recesses 14, and the shaped foil 4. Finally, the plate element 16 is attached or pressed on.

The connecting material 24 may be of a type that is different from the connecting material 22, so that the properties can be adapted to the sub-surface 26 and of the plate element 16, respectively.

In connection with the embodiment according to FIG. 2, the shaped foil 4 is also peeled off from the side for removing the plate elements 16 from the sub-surface, wherein the projections formed by the connecting materials 22 and 24 are broken off in turn. In this manner, a plate element 16 can be detached from the sub-surface in a simple manner by exerting only a relatively low tensile force on the shaped foil 4.

A further benefit that is achieved with the fastening system described above lies in the fact that the shaped foil 4 forms a barrier layer between the plate element 16 and the sub-surface, which is advantageous for many application purposes. In addition, it is possible to obtain good noise and footstep-sound insulation.

The system described above can be modified in many different ways. For example, with the embodiment according to FIG. 1, it is possible by means of suitable elasticity of the shaped foil 4 to remove the plate element 16 upwards with completely non-destructive deformation of the shaped foil, wherein the projections filling the recesses 12 and formed by the connecting material 22 remain intact, so that it is possible to subsequently insert the plate element 16 again in the shaped foil, if need be.

Alternatively, it is possible to use connecting materials that can be elastically deformed in a defined manner, so that it is possible to remove the plate elements with elastic deformation of the connecting material both in connection with the embodiment according to FIG. 1 and the embodiment according to FIG. 2. It is possible also to form the shaped foil 4 with a wall thickness and with a material elasticity so that, in case of a rigid, hardened connection material, the form-fit connection is separable by elastic deformation of only the shaped foil 4.

Figure 3:
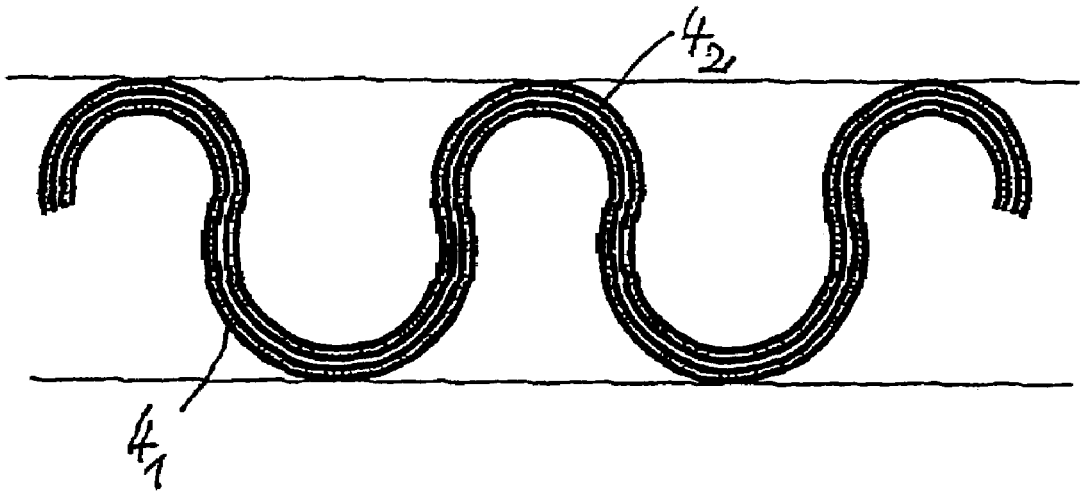
FIG. 3 is a cross section through two interlocked, wave-like shaped foils.

FIG. 3 shows two interlocked shaped foils $\mathbf{4}_1$ and $\mathbf{4}_2$.

If the single shaped foil 4 of FIGS. 1 and 2 is replaced by the double structure according to FIG. 3, the lower shaped foil $\mathbf{4}_1$ according to FIG. 3 is directly (FIG. 1) or via form-fit (FIG. 2) fixed to the substrate, and the upper shaped foil $\mathbf{4}_2$ is fixed to the plate element 16. With a suitably thick and elastic construction of the two shaped foils $\mathbf{4}_1$ and $\mathbf{4}_2$, the plate element 16 can then be removed from the substrate with elastic deformation of only the shaped foils $\mathbf{4}_1$ and $\mathbf{4}_2$, wherein the shaped foil $\mathbf{4}_2$ remains on the plate element 16. The shaped foil $\mathbf{4}_1$ fixed to the sub-surface is then immediately available again for laying new tiles, wherein it is possible again to work with a double foil by first inserting a shaped foil $\mathbf{4}_2$ into the shaped foil $\mathbf{4}_1$.

The systems can be structured as described with the help of FIGS. 1 and 2, wherein the double shaped foil $\mathbf{4}_1$, $\mathbf{4}_2$ is used instead of the shaped foil 4. Alternatively, the structure can be built in such a manner that the shaped foil $\mathbf{4}_1$, like the shaped foil 4, is first fixed to the sub-surface, the shaped foil $\mathbf{4}_1$ is fixed to the plate element 16 and the two shaped foils are then interlocked so as to form the structure according to FIG. 3.

Figure 4:
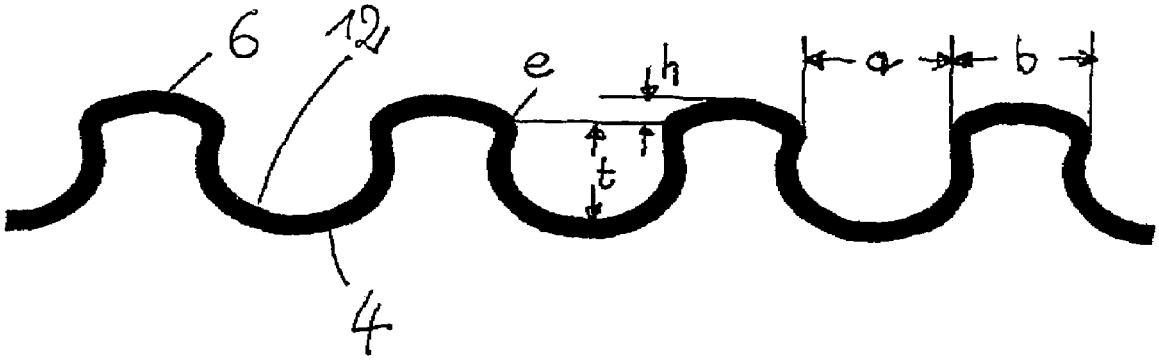
FIG. 4 is a cross section of a shaped foil as it is advantageously used for an assembly according to FIG. 3.

FIG. 4 shows a cross section through a shaped foil 4 that may consist of, for example, a plastic such as polystyrene, polyethylene or other suitable plastics, with a material thickness of about 0.3 to 1.0 mm, which is particularly advantageous for a double foil according to FIG. 3. According to FIG. 4, the shaped foil 4, which is sinusoidal-formed as a whole, comprises alternating, when viewed from above, projections 6 and the recesses 12. The recesses 12 each are formed in such a manner that, measured from the apexes of neighboring projections, their interior cross section first decreases, then widens towards a narrowest point "e", in order to then decrease again toward the bottom. In this way, the projections 6, which widen upwards in a generally mushroom-shaped form, alternate with recesses that each slightly expand downwards below the narrowest point.

Furthermore, FIG. 4 shows that the projections 6 and the recesses 12 are asymmetrical in the following respect, namely the width "a" of each recess is slightly smaller, in the area of the narrowest point, than the width "b" of each projection 6 in the area of its widest point. In addition, the projections 6 are formed in such a manner that they each extend by a lesser amount "h" above the respective widest point than the depth "t" of the recesses 12, each being measured from its narrowest point; i.e. the amount "h" is smaller than the amount "t".

Figure 5:
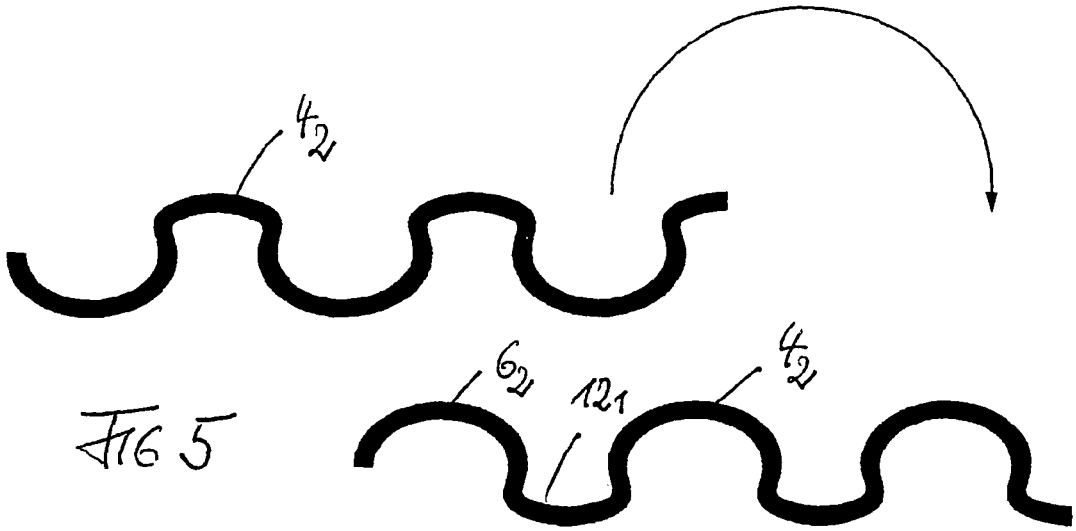
FIG. 5 is a representation for explaining the rotation of a foil piece by 180°.

On top, FIG. 5 shows a foil piece $\mathbf{4}_2$ in the position according to FIG. 2, and, at the bottom, shows the foil piece $\mathbf{4}_2$ rotated by 180° about an axis that is perpendicular to the plane of the paper. Viewed from the top in each case, FIG. 5 shows that, following the rotation by 180°, projections are turned into recesses, and vice versa. What is achieved with the embodiment described with the help of FIG. 4 is that the foil piece $\mathbf{4}_2$, which is rotated by 180° according to FIG. 5, is snap-fit insertable in a foil piece 4 disposed in the position according to FIG. 4, wherein the backsides of the projections $\mathbf{6}_2$ (previously recesses 4) engage the projections $\mathbf{6}_1$ of the lower shaped foil piece $\mathbf{4}_1$ from behind after overcoming the undercuts, and, in a similar way, the recesses $\mathbf{12}_2$ of the upper shaped foil $\mathbf{4}_2$ engage the recesses $\mathbf{12}_1$ of the lower shaped foil $\mathbf{4}_1$ from behind. The undercut is provided in each case due to the fact that the amount "a" (FIG. 4) is slightly smaller than the amount "b". The mutual clip-like engagement between the two shaped foil pieces $\mathbf{4}_1$ and $\mathbf{4}_2$ may take place through the elasticity of the wall material itself (thinning of the wall), or by elastically bending the shaped foil as a whole. The condition $h \leqq t$ (FIG. 2) ensures the additional benefit that intermediate spaces remain in each case between the shaped foil pieces $\mathbf{4}_1$ and $\mathbf{4}_2$, so that any dirt or particles that might be present on the surfaces of the pieces of shaped foil are stripped off when the pieces are pushed one into the other, and are accommodated in the unengaged intermediate spaces 132. Therefore, even when the conditions are not entirely clean, as frequently exist at construction sites, the foil pieces are safely connected with the components fixed to them.

Figure 6:
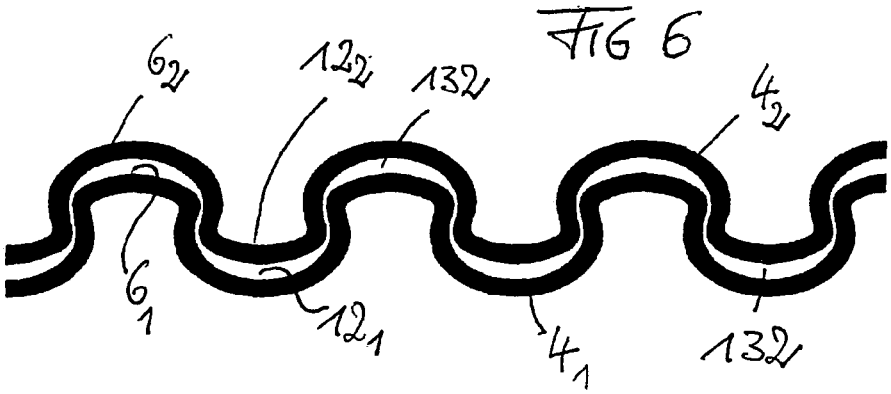
FIG. 6 is a detailed view of interlocked foil pieces according to FIG. 5.
Figure 7:
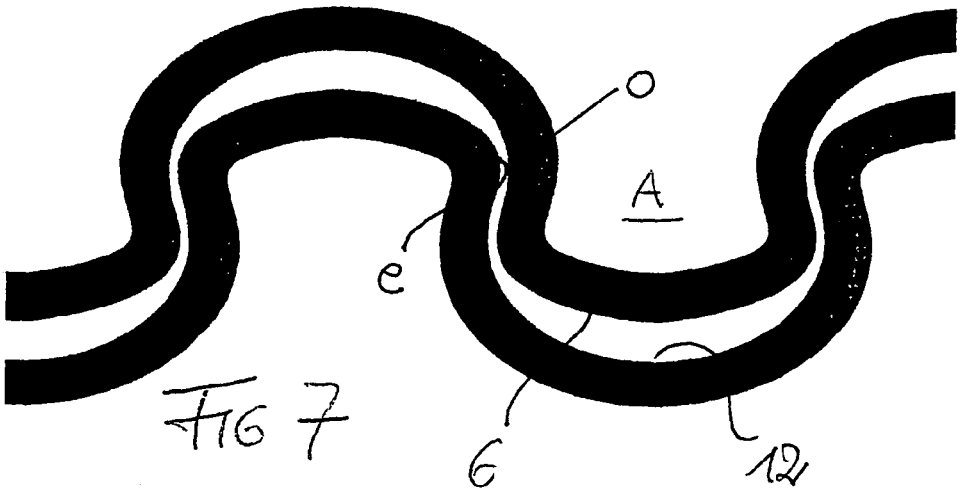
FIG. 7 is an enlarged, detailed view of the foil pieces according to FIG. 6.

FIG. 7 shows a cutout from FIG. 6 in an enlarged representation for elucidating the mutual geometric relationships. As is clearly apparent, the width within recess A formed by a "former" projection 6 is smaller than the width within recess 12 by about twice the amount of the wall thickness of the shaped foil.

The principle described above can be applied just as well to sinusoidal-shaped foils (the projections and recesses respectively form through-extending ribs and grooves) as it can be applied to shaped foils that are formed with small cups, as described by way of example in the following in connection with FIG. 15, or applied to shaped foils where the undercuts are formed by local thickenings or naps, as explained in connection with FIG. 14.

As explained with the help of FIG. 4, the important feature of the described shaped foil lies in that the inside width of the recesses 4 is in each case at least as large as the outside width of the projections. What is achieved in this way is that two foil pieces that are rotated by 180° with respect each other and are part of the same shaped foil will fit one into the other without any permanently crushed spots or deformations, whereas due to the wall thickness of the shaped foil, pieces with the same formation of projections and recesses will otherwise not fit one into the other without contact after the respective undercuts have been overcome (see FIG. 7). As is collectively apparent from FIG. 7, the narrowest point "e" of a recess 12 is, by about two times the amount of the wall thickness, wider than the narrowest point "o" on the backside of a former projection 6, which, upon rotation of the foil piece by 180°, forms a recess that opens upwards. The amount "b", for example, may be, by almost the amount of one wall thickness, greater than the amount "a". Owing to the fact that the foil pieces $\mathbf{4}_1$ and $\mathbf{4}_2$ are received one in the other at least substantially free of deformation after their interlocking, a fatigue-free and durable connection is created. It is understood that the shaped foil also may be embodied in such a manner that, in the condition shown in FIG. 7, a slight mutual abutment is present with minor elastic deformation. It is understood that the shaped foils, in particular if they are retained one in the other only in a form-fit manner, are applied to the substrate in such a manner that the recesses or projections extend horizontally.

FIGS. 8 and 9 correspond with the assemblies according to FIGS. 1 and 2, whereby the foil of FIG. 8 drawn by a thick line is a double structure, i.e. consisting of the two shaped foils $\mathbf{4}_1$ and $\mathbf{4}_2$. FIG. 9 represents a double foil according to FIG. 7 that is composed of a foil according to FIGS. 4 and 5. The center part of FIGS. 8 and 9 represents a sub-surface in the form of a plaster board 28 that comprises stabilizing layers on both sides consisting, for example of paper, a fiber mat or other materials.

It is advantageous in some applications if the shaped foil 4 does not form a gas or moisture barrier. In the embodiment according to FIG. 10, the shaped foil 4 is provided with the passage holes 32.

The embodiment of the shaped foil according to FIG. 11 is characterized in that the shaped foil is provided with coatings 34, for example, by immersing its sinusoidal-shaped bulges in a bath in such a manner that the form-fit is enlarged. Such a form-lock exists for the volumes $V_1$ in the presence of a movement upwards, and for the volumes $V_2$ in the presence of a movement downwards out of the shaped foil 4. The undercut between the volumes $V_1$ and $V_2$ need not necessarily be made by bending the shaped foil 4. The shaped foil 4 could be bent at a right angle in each case (grooves having vertical side walls and a horizontal bottom wall). The form-fit or undercut would be provided in that case only by the coatings 34. It is sufficient for many applications if only the underside or the top side of the shaped foil 4 is provided with the coatings 34.

It is clearly shown in FIG. 12 that the recesses of the shaped foil 4 may be filled or foamed with an elastically-flexible filler 36 (FIG. 12*a*), or filled with a filler 38 (FIG. 12*b*). The fillers 36 and 38 may replace the connecting materials 22 and 24 that are used, for example in the FIGS. 1 and 2.

Figure 13:
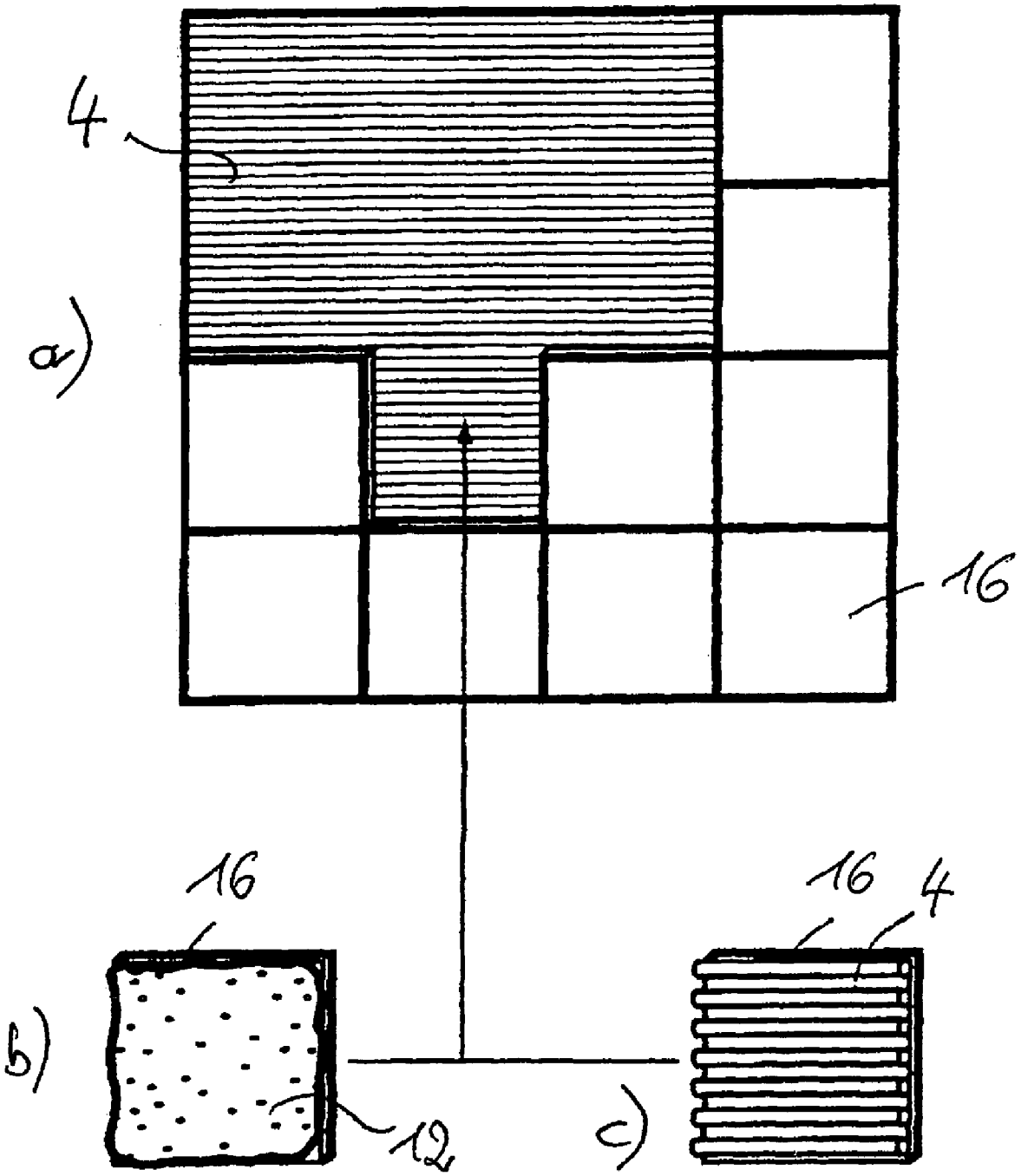
FIG. 13 shows different ways of fixing tiles to a sub-surface.

In part (a), FIG. 13 shows a top view of a wall that is provided with a shaped foil 4 like the substrates 18 or 26 of FIG. 1. This wall is partially covered with the plate elements 16, which are, for example tiles.

FIG. 13*b* shows the backside of a plate element 16 that is provided with a connecting material, for example with the connecting material of FIG. 1. The plate element 16 is pressed onto the shaped foil 4, so that the form-fit connection is produced after the connecting material 12 has hardened, as was explained with the help of FIGS. 1 and 2.

In FIG. 13*c*, an additional shaped foil 4 is fixed to the backside of the plate element 16, for example by disposing a suitable connecting material therebetween. The plate element 16 of FIG. 13*c* can be fixed to the wall in a simple manner by inserting the plate element 16 with its shaped foil 4 in the other shaped foil 4, so that the structure of FIG. 3 with the form-fit connection between the two shaped foils is obtained. It is understood that such an insertion is possible either by elastically deforming the shaped foils 4 themselves, or by maintaining at least one of the two filled connecting materials in an elastically-flexible condition, for example by using a suitable foam material.

Figure 14:
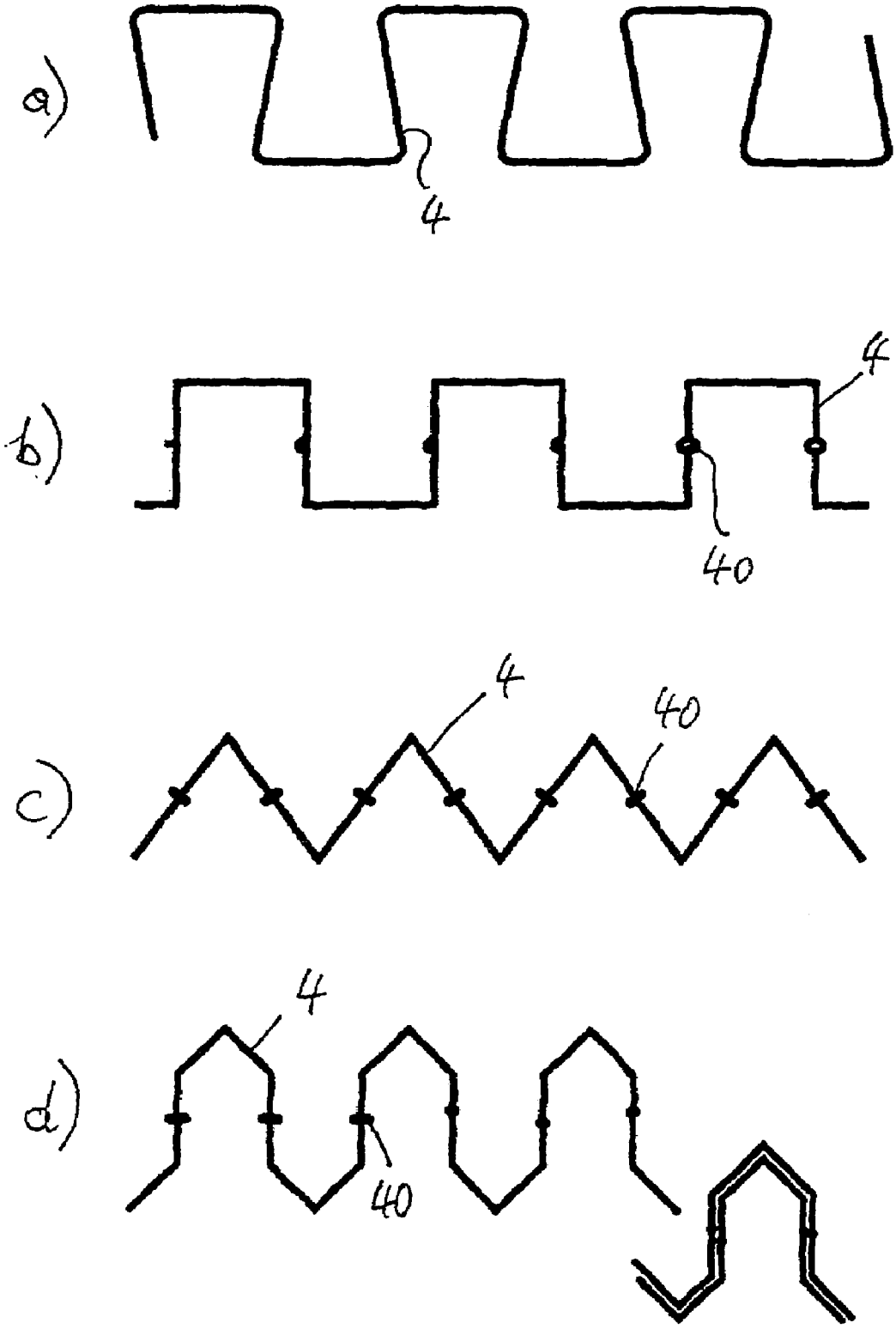
FIG. 14 shows cross sections through different embodiments of shaped foils.

FIG. 14 shows different cross sections through shaped foils.

The shaped foil 4 shown in FIG. 14*a* is sinusoidal-shaped in such a manner that its projections each widen towards the closed side, and its recesses narrow towards the open side.

In connection with the shaped foil 4 according to FIG. 14*b*, which has perpendicular side walls, the form-fit connection is produced by providing the side walls with bulges 40.

Similar considerations apply to the embodiment of the shaped foil 4 according to FIG. 14*c*, which is saw tooth shaped in cross section, and is provided with bulges 40, which ensure that material, which is accommodated in the saw tooth-shaped recesses in cross section, is interlocked or form-fit accommodated therein.

The embodiment of the shaped foil 4 according to FIG. 14*d* combines the cross-sections of FIGS. 14*b* and 14*c*.

In particular, the embodiments according to FIGS. 14*b* and 14*c* are suited for the double-shaped foil structure of FIG. 3 (indicated on the right in FIG. 14*d*).

Figure 15:
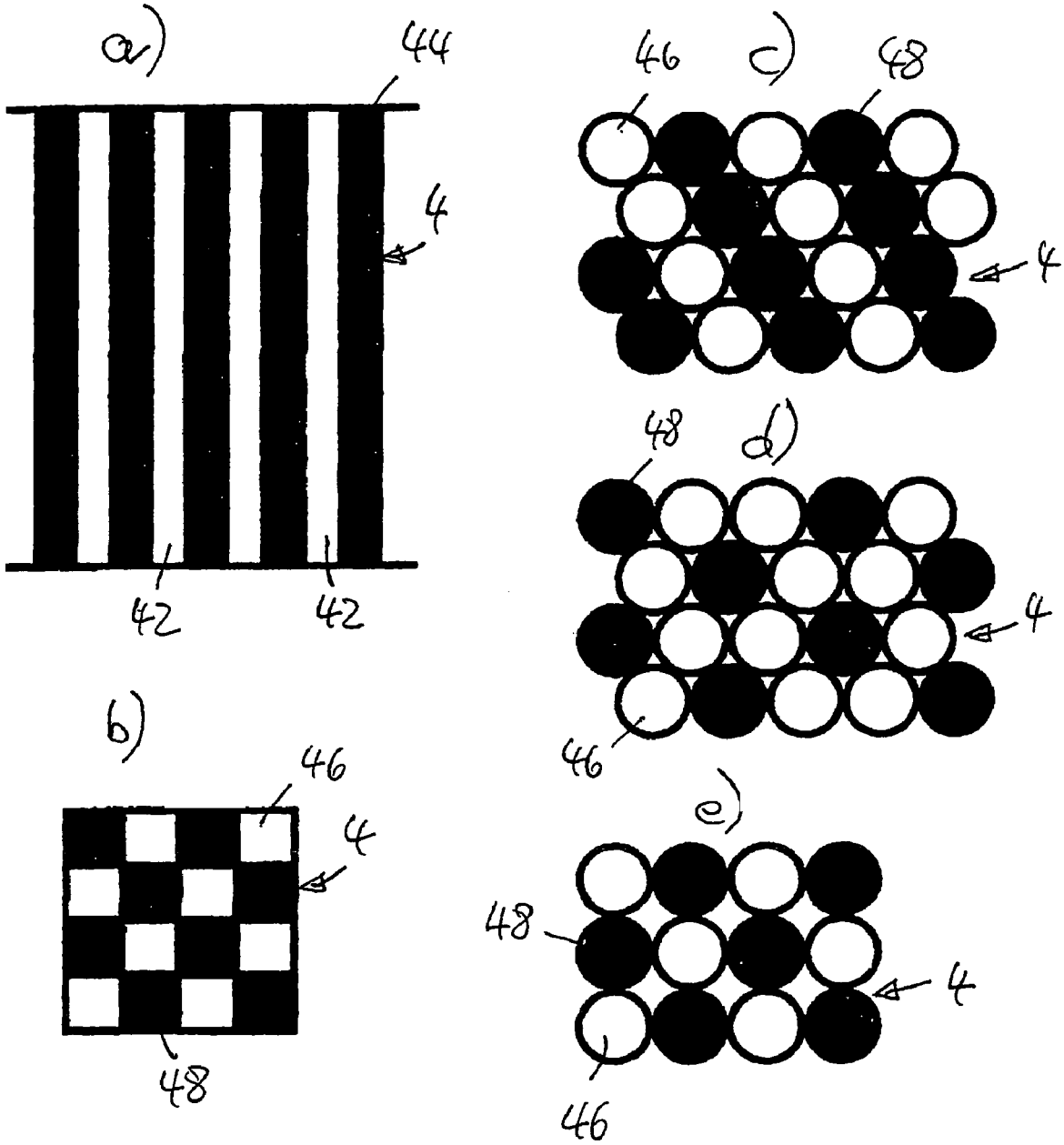
FIG. 15 shows schematic top views of different types of shaped foils.

FIG. 15 shows top views of different embodiments of shaped foils.

The shaped foil according to FIG. 15*a* is sinusoidal-shaped and has grooves 42 extending parallel with each other, which grooves are separated by projections 44.

The embodiment of the shaped foil according to FIG. 15*b* has the recesses or outward bulges 46 and the protrusions 48 that alternate with each other in a checkered pattern.

The embodiments according to FIGS. 15*c* to 15*e* also have the recesses 46 and the protrusions 48 that are arranged in different configurations, whereby the recesses 46 are drawn as circles and the outward bulges 48 as dark disks.

It is understood that the side walls not shown in FIG. 15, which extend between the recesses and the projections approximately perpendicular to the plane of the paper, are formed in such a manner that undercuts are formed. All shown foils, for whose configurations numerous other possibilities are available, can be used as individual shaped foils or double shaped foils.

The shaped foils may be made of different materials, for example of thermoplastic foils, in a form of polymerized plastic sheets, etc. Metallic foils are also, in principle, suitable.

Figure 16:
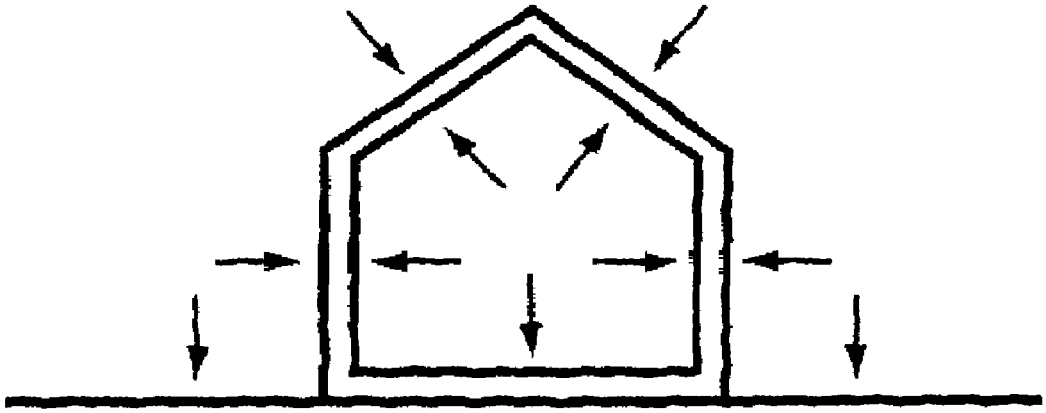
FIG. 16 is the view of a house for explaining the functional benefits achieved through the application of the invention.

According to FIG. 16, the invention is suitable for all applications in and around a building, for example for all inside as well as outside surface areas, and also for balconies. It is explained in the following that the invention is inherently suitable for forming moisture barriers, gas barriers, thermal insulation systems, noise and footstep-sound insulation systems, etc., or can be integrated in the installation of paneling, such as tiles, plate elements, etc.

Figure 17:
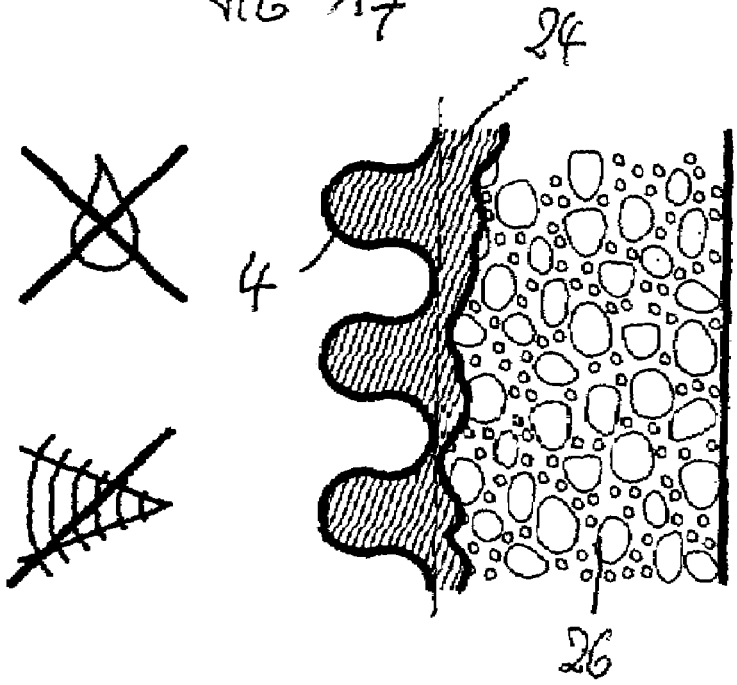
FIG. 17 shows an example of a shaped foil fixed to a brickwork.

FIG. 17 shows an example of how a shaped foil 4 can be fixed to a plaster or directly to a brickwork 26 by means of an elastically or rigidly hardening connecting material 24. Uneven surfaces of the brickwork 26 can be smoothened with the help of the connecting material 24, so that the shaped foil 4 will then extend in a planar manner as a whole and be suited for attachment of other components. The shaped foil 4 may be made in such a manner that it will form a moisture barrier. The connecting material 24 can be made in such a way that it will contribute to sound proofing.

Figure 18:
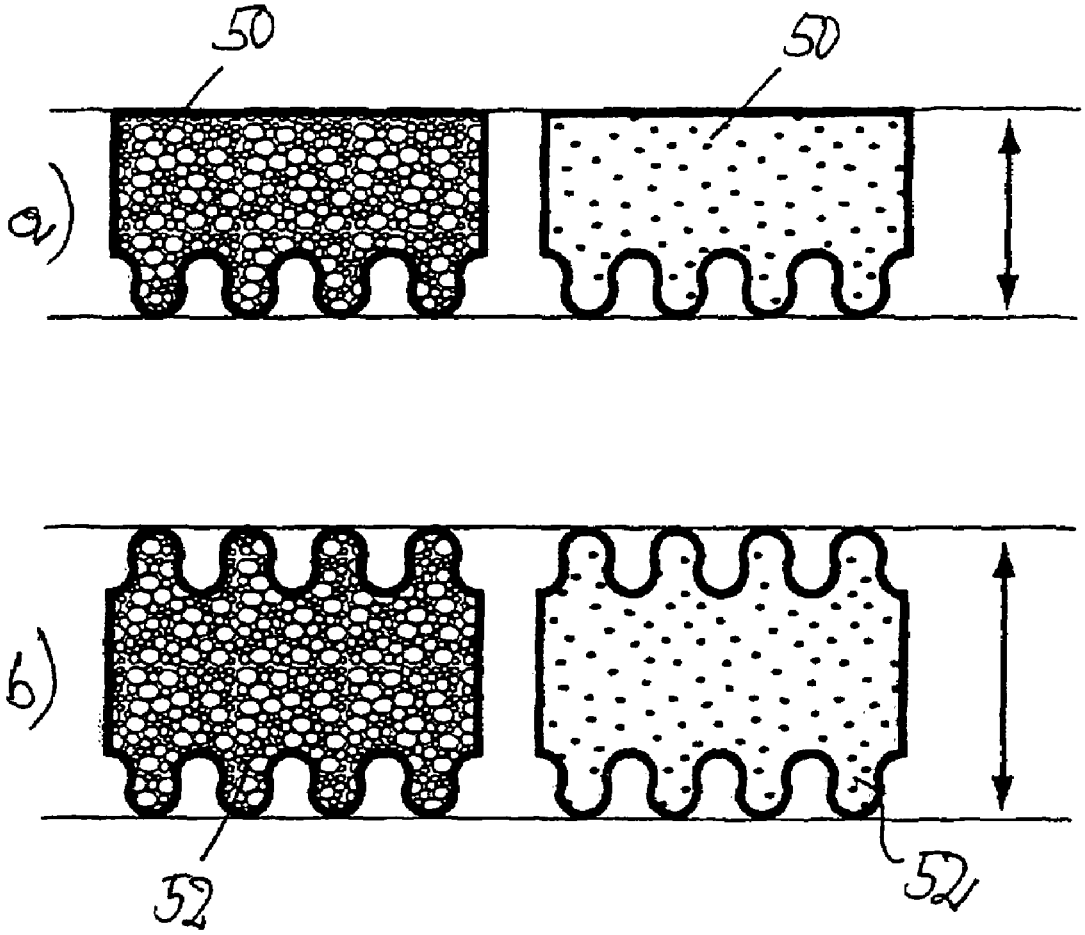
FIGS. 18 and 19 show cross sections through different embodiments of connecting components.

FIG. 18 shows connecting components as they can be employed as auxiliary components in the inventive connection system. FIG. 18*a* shows connecting components 50 that have a wave- or sinusoidal-shape on one side surface, and extend in a planar manner on the opposite side surface. The filling of the connecting components 50 may be rigid per se or elastically-flexible to a certain extent. The connecting components 50 can be manufactured in such a manner that the finished connecting component as a whole is produced in a mold or extruded, if necessary, or, in a manner similar to the one explained with the help of FIGS. 1 and 2, is incorporated in a material that cures, for example in a rectangular mold with a planar bottom, into which a shaped foil is pressed from one side. Following hardening, the connecting component provided with the shaped foil can then be removed from the mold.

In connection with the embodiment according to FIG. 18*b*, the connecting component 50 is sinusoidal-shaped with projections and recesses alternating on the two opposing side surfaces.

The plate components 50 and 52 of FIG. 18 exhibit excellent thermal insulating effects, particularly if the filler is Styropor. When heavier fillers having inner friction are used, it is possible to obtain excellent sound insulation properties. A good compensating effect is achieved if Rigips is employed as the filler.

Figure 19:
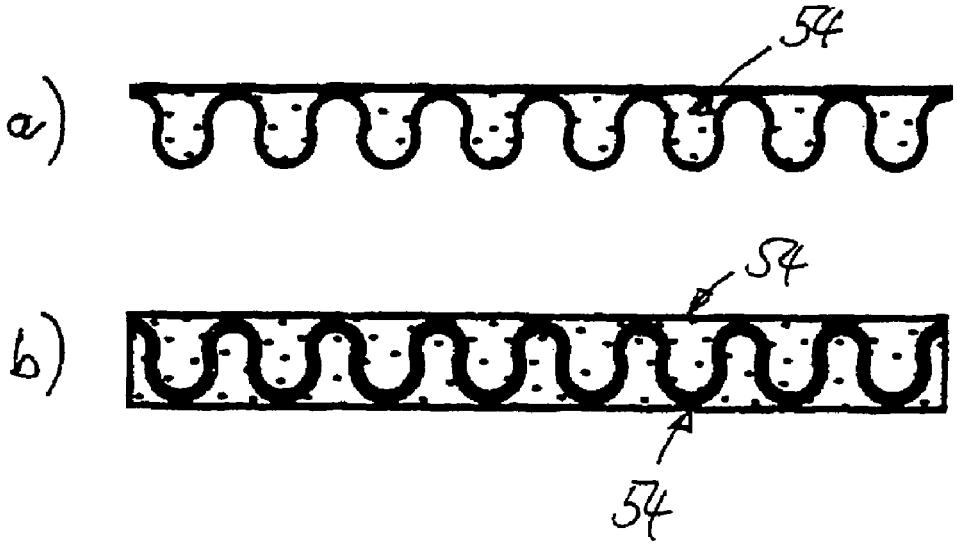

FIG. 19 shows a connection component 54 that is planar on one side and is provided on the other side with alternating bulges and protrusions, wherein the connection element is as a whole very flat because the bulges and/or recesses reach up to the planar backside of this connecting component. Again, the connecting component 54 can be produced in a mold as a slightly elastic molded component made, for example of foamed plastic, or it can be produced by using a shaped foil that is connected with a base plate, with a filler arranged in between, wherein the filler bonds with the base plate.

FIG. 19*b* shows two connecting components 54 that are joined or interlocked with each other.

Figure 20:
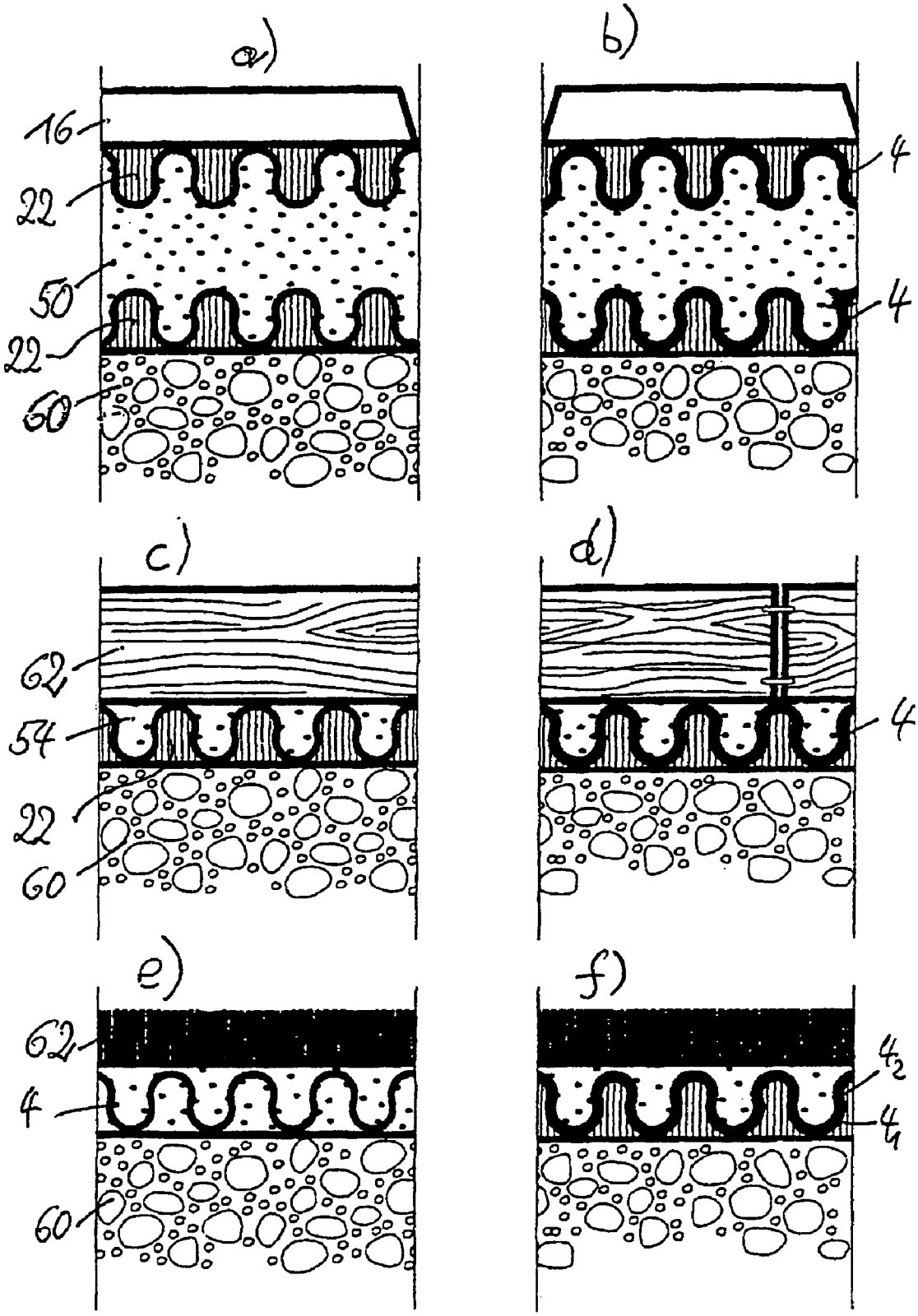
FIG. 20 shows different applications of the connecting components according to FIGS. 18 and 19.

FIG. 20 shows different applications of the previously-described structures.

FIG. 20*a* shows a structure where a plate element 16, for example a floor tile, is fixed to a floor 60 with a plate component 50 arranged in between as an impact noise plate. Like the connection between the connecting component 50 and the floor 60, the connection between the plate element 16 and the connecting component 50 can be produced indirectly via the hardenable connecting materials 22, or also by fixing a shaped foil to the plate element 16 or the floor 60 by means of the connecting material. In this way, the structure can be disassembled in a simple manner. Similarly, a connecting component as shown in FIG. 19 can be arranged between the plate component 50 and the floor 60, or the plate element 16, as shown in FIG. 19.

FIG. 20*b* corresponds to FIG. 15*a*. The thick-drawn corrugated line should make clear that two shaped foils 4 are employed in each case. It is understood that the two shaped foils 4 can be used only on the top side or on the bottom side of the plate component 50.

FIG. 20*c* represents a structure in connection with which a wooden floor 62 is adhered together with a connecting component 54 according to FIG. 14*a*. This connecting component 54 is fixed to a sub-surface, for example to a stone floor, for example directly via the hardening connecting material 22.

The embodiment according to FIG. 20*b* corresponds with the one of FIG. 20*c*, wherein again, a double shaped foil 4 is employed.

In connection with the embodiment according to FIG. 20*e*, a carpet 62 is fixed to a floor 60 with a shaped foil 4 arranged in between, wherein the connection can be realized, for example in a manner similar to the one shown in FIG. 2, or by using one or two of the connecting components 54 according to FIG. 19. FIG. 20*f* again indicates the use of two shaped foils between the carpet 62 and the floor 60.

It is understood that the structures described above only represent exemplified embodiments, and that the inventive system with the form-fit engagement between protrusions and recesses, as well as with the beneficial intermediate arrangement of one or more shaped foils, permits numerous modifications and applications.

Figure 21:
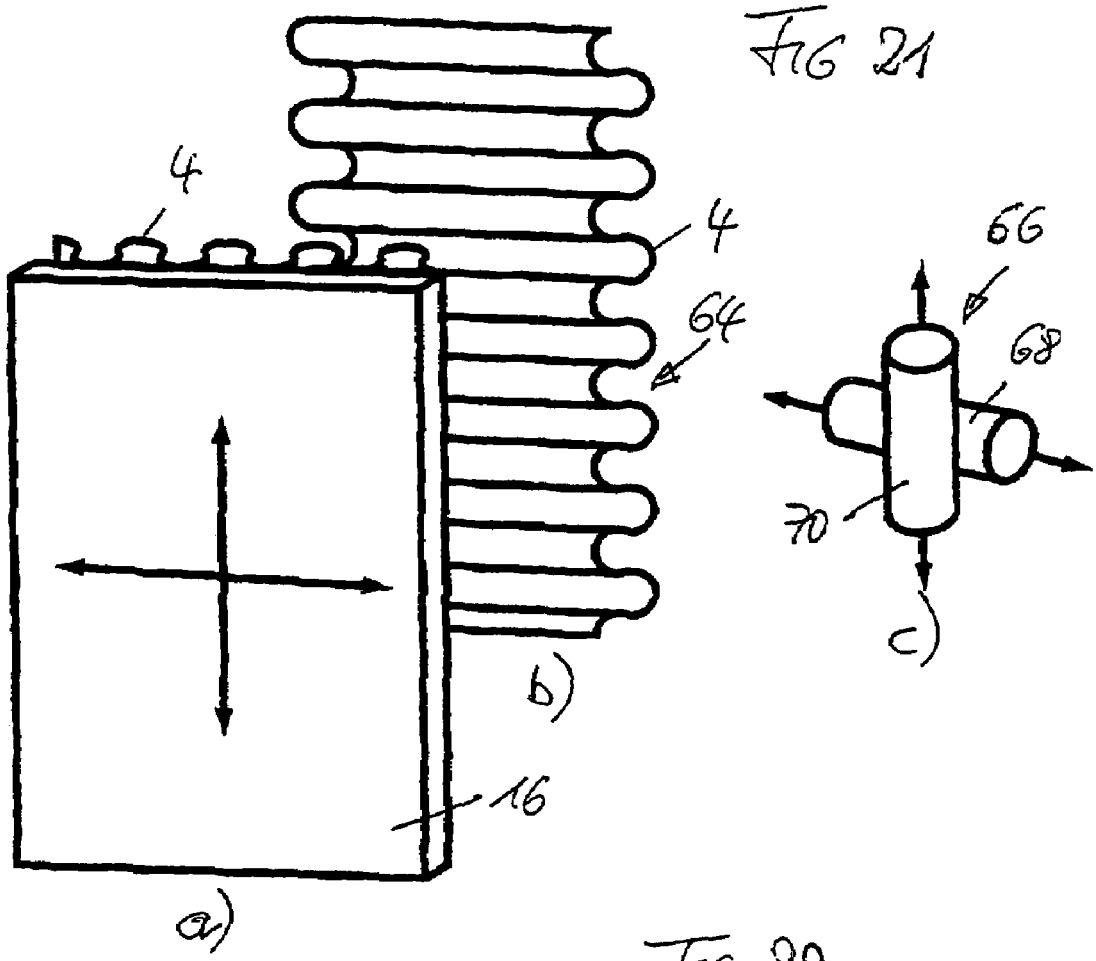
FIG. 21 shows a system for attaching a tile to a sub-surface in a re-positionable manner.

FIG. 21 shows a plate element 16 that is provided on its backside with a shaped foil 4, and a sub-surface 64 that is provided with a shaped foil 4 as well. The grooves of the two shaped foils 4 extend perpendicular in relation to each other. So as to be able to fix the plate element 16 to the sub-surface 64, a connecting element 66 (FIG. 21*c*) is provided that is comprised of two rod elements that are arranged at a right angle in relation to each other, and that are rigidly joined with each other on their peripheries. These rod elements are dimensioned in such a manner that they fit into the grooves of the shaped foils 4. As is clearly apparent, the plate element 16 can be secured on the sub-surface 64 by clipping the rod elements of the connecting elements 66 into the grooves of the shaped foil if the rod elements are suitably elastic for this purpose, or by inserting the rod elements sideways. Furthermore, it is possible with the help of the connecting element 66 to re-position the plate element 16 relative to the sub-surface 64 (which may be a plate-shaped component as well) in the direction of the rod elements 68 and 70.

It is understood that the plate element 16 and the sub-surface 64 do not necessarily have to be provided with shaped foils, but may be realized in the form of molded elements in which the sinusoidal-shaped structure of the grooves is integrated.

Figure 22:
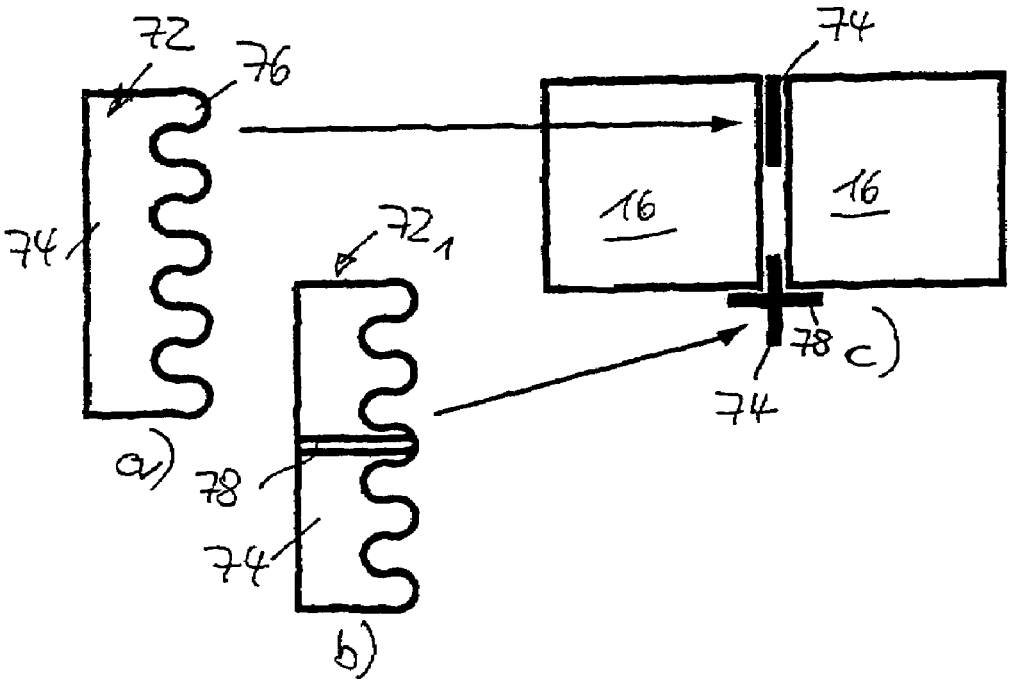
FIG. 22 shows auxiliary spacer components for the installation of tiles.

FIG. 22 shows in FIG. 22*a* a spacer component 72 that, as a whole, is formed by a flat component that has a spacer bridge 74. This bridge ends in the sinusoidal-shaped protrusions 76, which are formed in such a manner that they can be clipped into a structure of grooves corresponding to the sub-surface 64 shown in FIG. 21. The plate elements 16 are fixed to said grooves. As is directly apparent in FIG. 22*c*, the spacer bridge 74 arranged between the plate elements 16 advantageously serves the purpose of fixing the distance between the plate elements 16 if the latter are re-positionable in the horizontal direction according to FIG. 22.

According to FIG. 22*b*, the spacer component 70 is additionally provided with a bridge 78 that extends at a right angle in relation to its spacer bridge 74, so that according to FIG. 22*c*, the result is a spacer cross, by means of which it is possible to fix the relative position of four plate elements.

Figure 23:
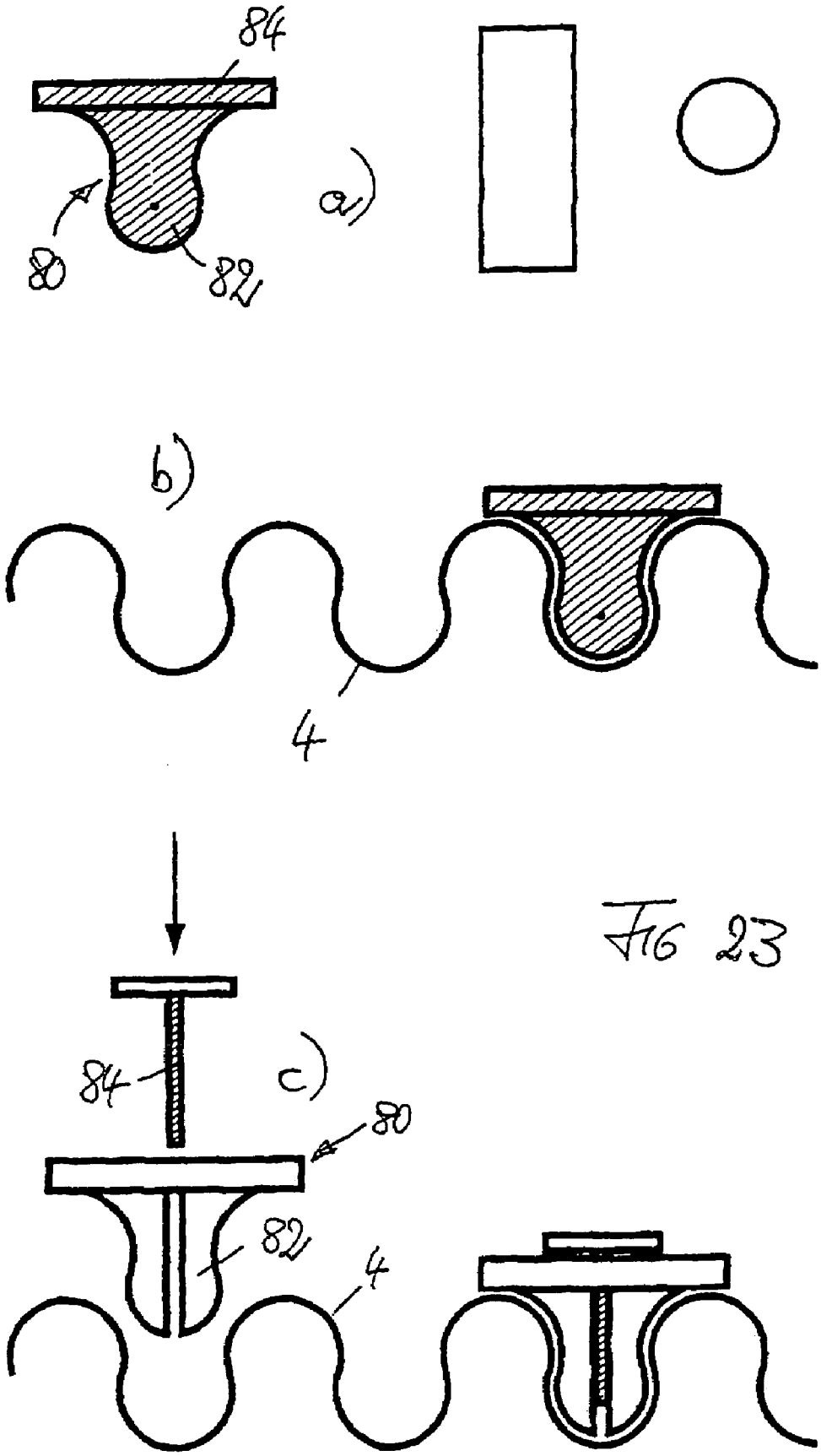
FIG. 23 shows a fastening element with diagrams for explaining the function thereof.

Fastening elements that can be used on a sinusoidal-shaped structure of recesses and projections of the type as provided, for example by a shaped foil, are explained with the help of FIG. 23.

FIG. 23*a* shows a cross section and top views of a fastening element 80 that comprises a projection 82 with a shape that is adapted to the recesses of a shaped foil, and a face 84 which, viewed from the top, is rectangular or round or shaped in some other way. According to FIG. 23*b*, the projection 82 can be clipped into a recess of a shaped foil 4.

In the embodiment according to FIG. 23*c*, the projection 82 is divided or has a spread hole into which a spreading screw 84 can be screwed, so that the fastening element 80 can be inserted first with its projection in a recess of a shaped foil without the necessity of an elastic deformation, and can then be spread as the spreading screw 84 is being screwed in, so that it is retained in the shaped foil or a corresponding recess in a fixed manner.

It is beneficial for many applications to cover a large surface area with shaped foil, or to adjoin shaped foils at an angle to each other. A plug connector for shaped foils is explained with the help of FIG. 24.

Figure 24:
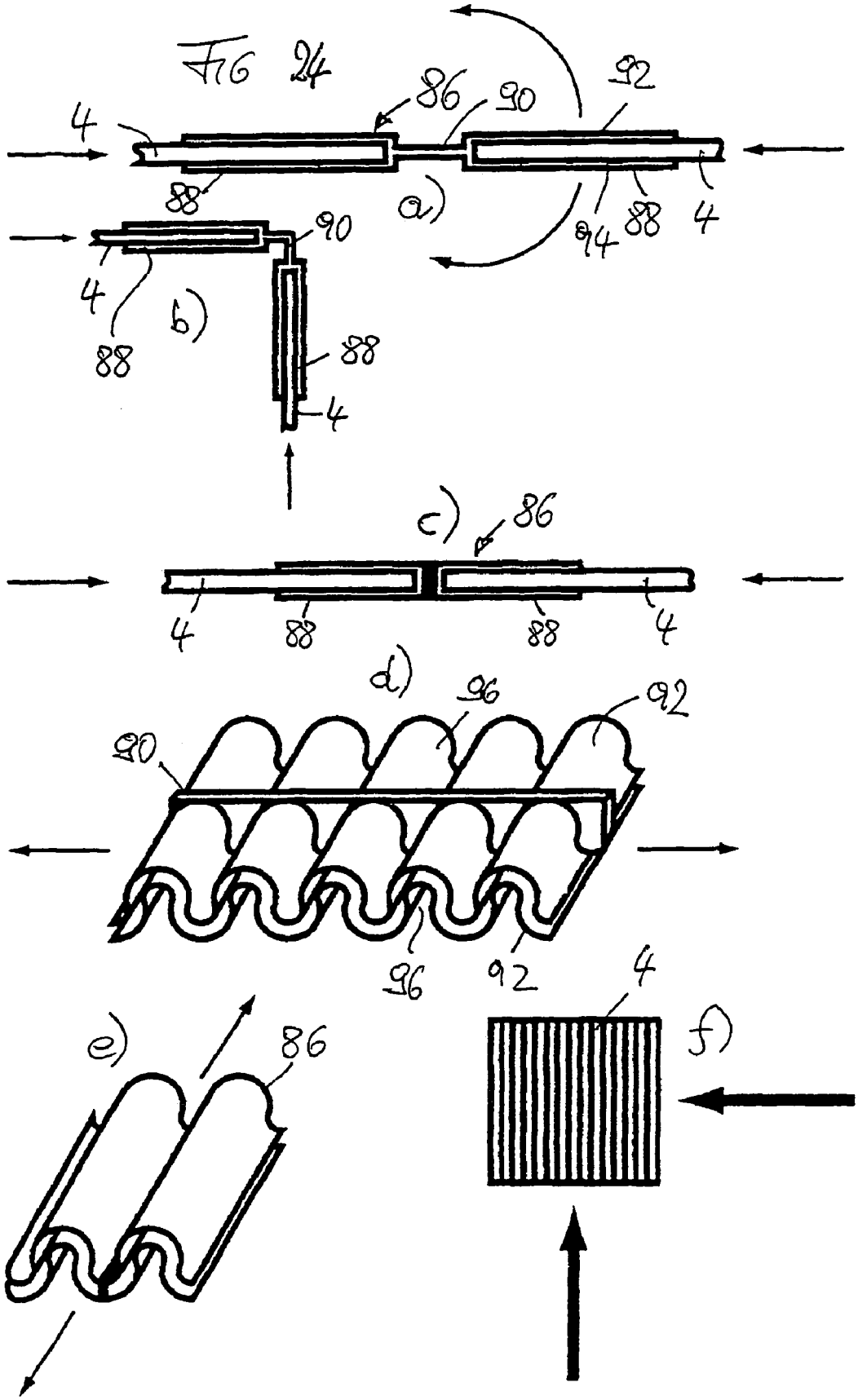
FIG. 24 shows a plug connector with diagrams for explaining the function thereof.

FIG. 24 shows a plug connector for connecting the two shaped foils 4, which are first arranged laterally next to each other. The plug connector 86 has receiving shafts 88 that are arranged on its oppositely disposed sides, which shafts 88 are connected with each other via an intermediate component 90. Each receiving shaft has an upper wall 92 and a lower wall 94, with an insertion slot being formed between said walls for inserting the shaped foil 4. The upper wall 92, which in FIG. 24*a* is visible only by a cross sectional view, the lower wall 94 and the insertion slot formed between said walls each are adapted to conform with the shaped foil 4 to be inserted therein. The intermediate component 90 is made of a flexible material, so that the two receiving shafts 88 can be arranged at an angle in relation to one another (see FIG. 24*b*).

FIG. 24*c* shows an embodiment of the plug connector 86, in connection with which the intermediate component 90 is shortened and rigidly formed.

FIG. 24*e* is a perspective view of the plug connector 86 of FIG. 24*c* that is set at a small angle in relation to the direction of insertion. Visible are the corrugated upper wall and the corrugated lower wall with the intermediate component 90 realized in the form of a bridge. The grooves 96 formed on the upper and lower sides advantageously correspond with the grooves of the shaped foil 4 (FIG. 24*f*).

The plug connector 86 shown in FIGS. 24*a* and *d* allows shaped foils to be connected in the direction in which the grooves extend. FIG. 24*e* shows an embodiment of a plug connector 86 by means of which two neighboring shaped foils can be joined that are arranged next to each other perpendicular to the direction in which the grooves extend.

As FIG. 24 shows, it is possible by means of the plug connectors to join individual shaped foils so as to form a large shaped foil area, wherein, owing to the design of the plug connectors with the grooves 94 on their top and bottom sides, it is possible to mount, for example, tiles in the area of the plug connectors just as well as in the area of the shaped foils. The insertion slot has a cross section that corresponds with the one of the shaped foils, so that the latter are accommodated in the slot in a fixed manner. The entire structure with its large surface area can be realized therefore in a watertight manner.

Figure 25:
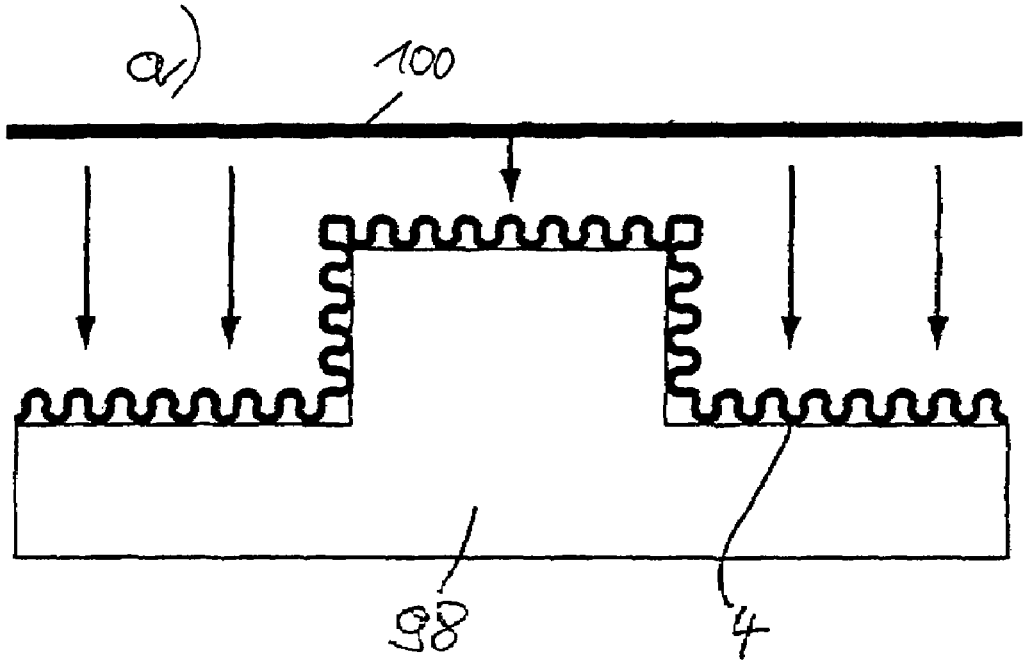
FIG. 25 shows a floor tub.
Figure 25:
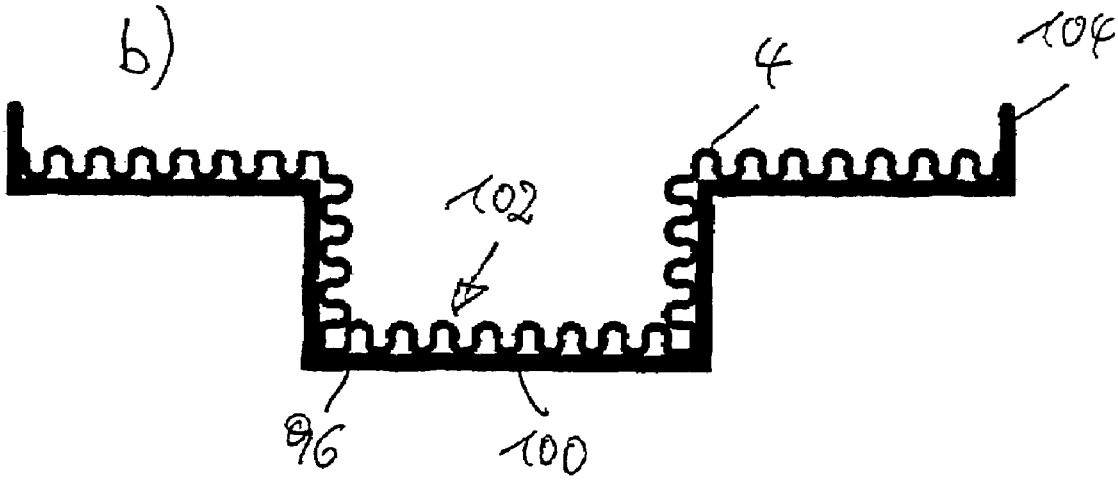

FIG. 25 shows by way of example how it is possible with the inventive shaped foil 4, to build a floor tub, for example a shower floor tub that is reliably watertight, on the one hand, and can be covered with tiles on the other hand, wherein the tiles can be replaced in a simple manner.

According to FIG. 25*a*, a molding tool 98 is provided whose contour corresponds with the negative contour of a tub to be built. A shaped foil 4 is fixed to the top side of the molding tool 98 in such a manner that it flatly abuts the top side of the molding tool 98. If the shaped foil 4 is made of a thermoplastic material, this can be accomplished, for example by slightly heating the shaped foil 4 in the area of the edges—if any—of the molding tool 98, so that the shaped foil will form corresponding edges. In the condition shown in FIG. 25*a*, a base plate 100 is attached to the top side of the shaped foil 4 that is disposed on the top side of the molding tool, wherein this base plate 100 is advantageously made of a thermoplastic material as well, so that it can be directly attached to the shaped foil by heating it and, for example by means of molding punches (not shown), and can then be fused with the shaped foil. Alternatively, a hardenable connecting material can be applied to the top side of the shaped foil 4 that will connect, when hardened, at least to the base plate 100.

After the structure described above has been completed, it is removed from the molding tool 98 from the top and turned over, so that the tub according to FIG. 25*b* is formed. This tub is reliably watertight because it is produced in the form of one single piece, and it can be covered with tiles in the manner described with the help of the examples specified above. It is understood that the tub 102 may be realized in such a manner that it is only partly covered with tiles, so that the base plate 100 is directly visible in some areas. The base plate is advantageously drawn upwards along its edges 104, so that, for example a shower tub is provided that can be sealed against walls in a simple manner.

Figure 26:
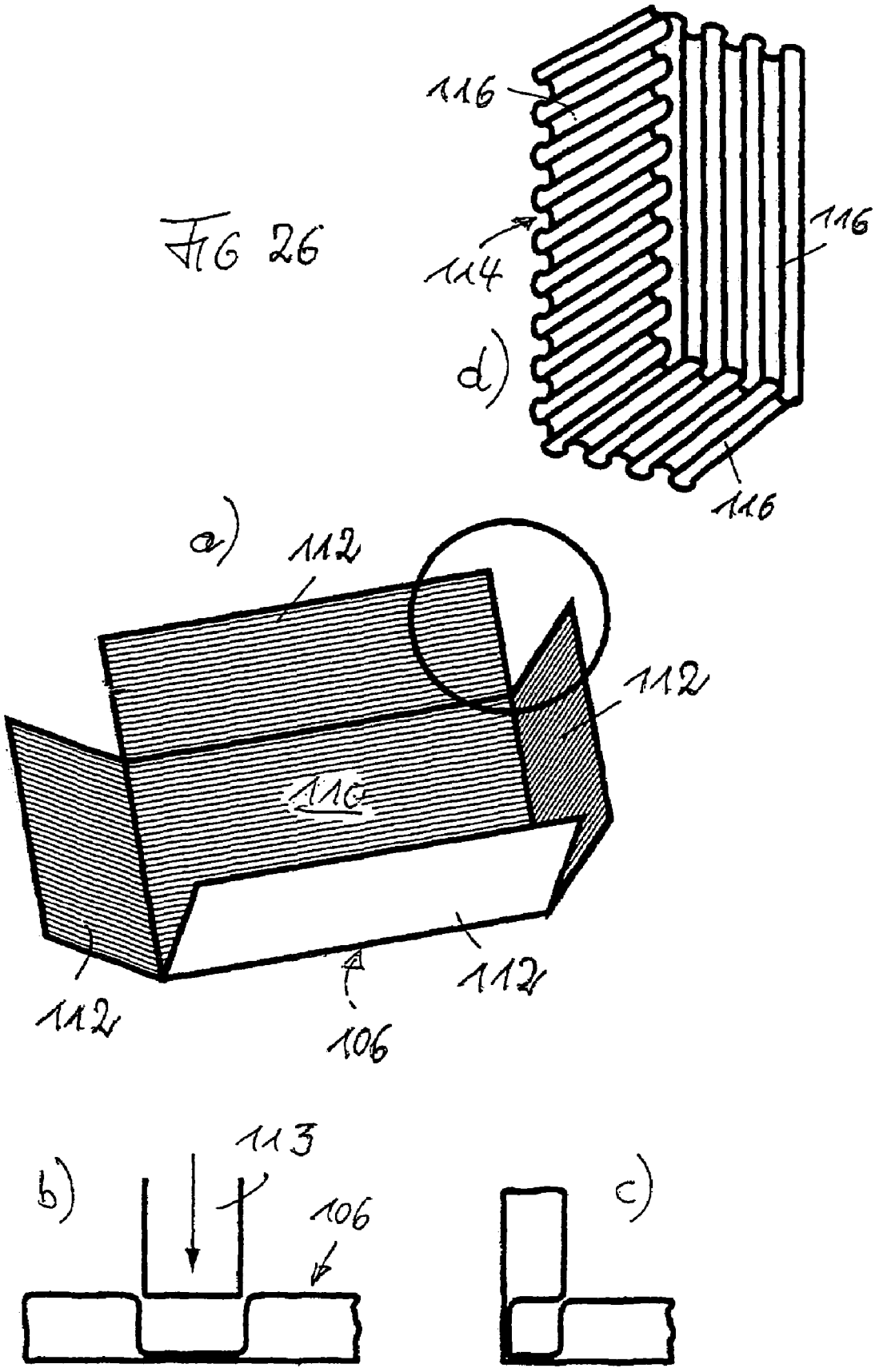
FIG. 26 shows another embodiment of a floor tub with a corner connection body.

Another example showing how a body that can be covered with tiles can be produced in a simple manner is shown with the help of FIG. 26. According to FIG. 26*a*, a base plate, which is realized in the form of a shaped foil 4 with adequate inherent stiffness, is folded like a cardboard box by drawing its edge areas upwards, so that a bottom 110 is produced from which the side walls 112 project. In the interest of superior foldability, the base plate 106 is pressed flat in the area of the resulting folding lines or edges, advantageously using, for example a heated punch 113 (FIGS. 26*b* and *c*).

For connecting the side walls 112 of the resulting box-type body, a corner connector 114 is provided that is produced, for example by deforming a shaped foil, or in the form of a molded part. In the area shown, this corner connector comprises three walls 116 that are perpendicular with respect to each other and realized in the form of one single part. These walls comprise grooves that correspond with the grooves of the bottom 110 and the grooves of the side walls 112.

The corner connector 114 may be joined with the box on the inside or on the outside by clipping the respective grooves one into the other, allowing for a form-fit connection. With the preferred additional use of an adhesive, a tight tub is obtained that can be covered in a simple manner with tiles on the inside and/or on the outside, for example by a method described in the foregoing. It is understood that the form-fit connection can be produced also via recesses and protrusion realized other than in the form of grooves (see FIG. 9).

Figure 27:
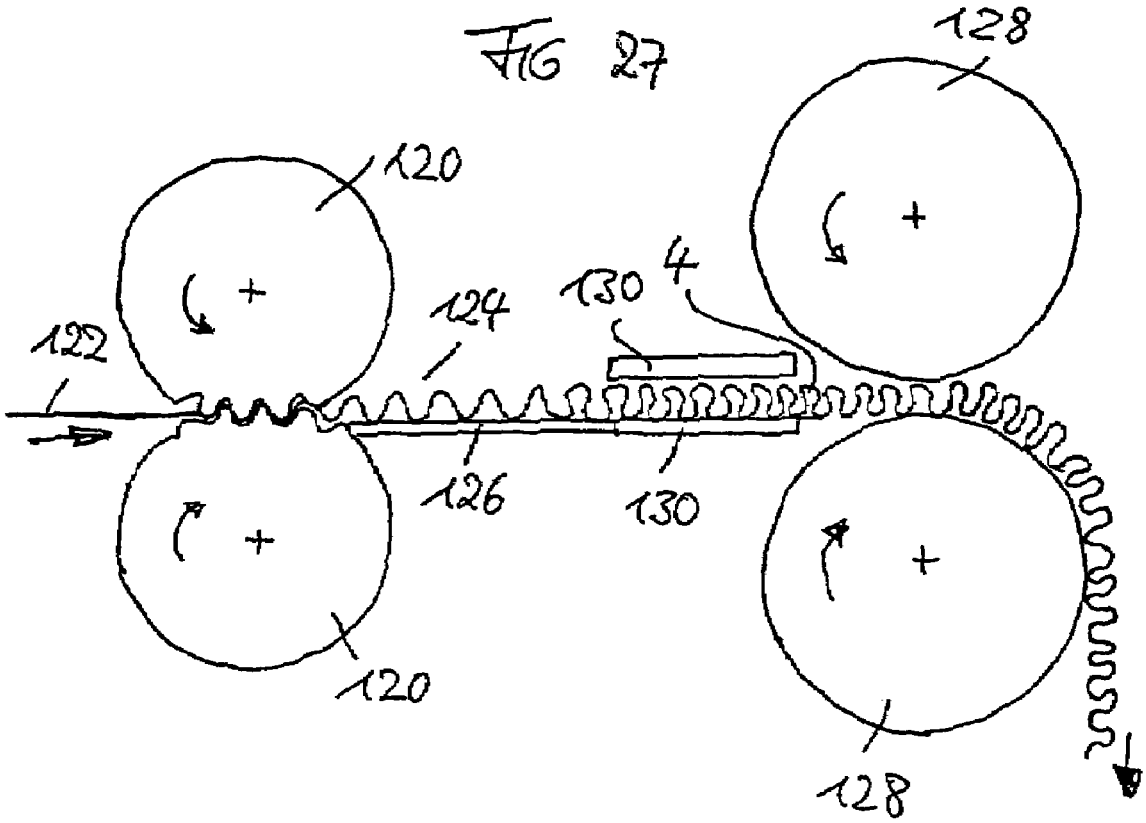
FIG. 27 shows an example of the manufacture of a shaped foil formed with grooves.

FIG. 27 shows an example of the manufacture of a shaped foil 4 formed with grooves.

The two molding rolls 120, which are mutually engaged and whose external peripheries are provided with grooves, rotate in such a manner that a foil made of thermoplastic material is pulled in. The foil 122 passing between the molding rolls is reshaped due to the grooves formed in the molding rolls, and by suitable heating, into a wave-shaped foil 124 that comprises grooves that are open upwards and downwards in an alternating manner, with a width that is at least constant or expanding. The wave-shaped foil slides over a table 126 and passes between the transport rolls 128, whose peripheral speed is less than the speed of the molding rolls 120, so that the wave-shaped foil moving across the table 126 is compressed. In the area between the molding rolls 120 and the transport rolls 128, heating devices 130 are provided that heat the corrugated foil 126. Due to the compression, the grooves are reshaped in such a manner that they are realized with the undercuts that are visible in particular in FIGS. 1 to 3. The shaped foil 4 is produced in this manner.

Advantageously, provision is made downstream of the heating devices 130 in the direction of movement of the foil for cooling devices (not shown) for stabilizing the foil. Furthermore, the surfaces of the transport rolls are designed soft in such a manner that the shaped foil will not be reshaped or overstressed by being in contact with said surfaces.

It is understood that different manufacturing methods can be applied depending on the design of the shaped foil.

LIST OF REFERENCE NUMERALS

4 Shaped foil
6 Projection
8 Projection
12 Recess
14 Recess
16 Plate element
18 Wooden panel
20 Wire clip
22 Connecting material
24 Connecting material
26 Brickwork
28 Plaster board
30 Stabilizing layer
32 Passage hole
34 Coating
36 Elastically-flexible filler
38 Filler
40 Bulge
42 Groove
44 Projection
46 Recess
48 Projection
50 Plate element
52 Plate element
54 Connecting element
60 Floor
62 Carpet
64 Sub-surface
66 Connecting element
68 Rod element
70 Rod element
72 Spacer component
74 Spacer bridge
76 Projections
80 Fastening element
82 Projection
84 Spreading screw
86 Plug connector
88 Receiving shaft
90 Intermediate component
98 Molding tool
113 Punching device
102 Floor tub

The invention claimed is:

1. A method for detachably affixing a planar component to a sub-surface using a first shaped foil and a second shaped foil, wherein the first shaped foil comprises a plurality of longitudinally-extending projections with longitudinally-extending grooves defined between peaks of adjacent projections such that the first shaped foil has an overall shape selected from the group consisting of substantially wave-shaped, substantially sinusoidal-shaped and substantially corrugated, wherein the internal lateral cross-section of at least one groove is defined such that, between a narrowed internal lateral cross-section and the bottom of the groove, an internal lateral cross-section that is wider than said narrowed internal lateral cross-section is provided, wherein a longitudinally-extending undercut is defined by said narrowed internal lateral cross-section, and wherein the longitudinally-extending projections and grooves are asymmetrical to the extent that the width of said undercuts is smaller than the lateral cross-section of each projection at its widest point, and wherein the shape of the second shaped foil is the same, or substantially the same, as the first shaped foil that has been rotated by 180°, wherein widest lateral cross-sectional points of longitudinally-extending projections of the second shaped foil are arranged and constructed to interlock with the respective longitudinally-extending undercuts of the grooves of the first shaped foil such that the second shaped foil is non-displaceably reined in the first shaped foil in at least one direction perpendicular to the longitudinally-extending grooves, wherein the method comprises:

affixing the first shaped foil to the sub-surface, applying the second shaped foil to the first shaped foil such that the longitudinally-extending undercuts of the first shaped foil interlock with said widest points of the longitudinally-extending projections of the second shaped foil, applying a first hardenable connecting material to the second shaped foil and/or to the planar component, wherein said first hardenable connecting material adheres to at least the planar component, and pressing the planar component onto the second shaped foil such that the first hardenable connecting material is at least partially received in the grooves of the second shaped foil and, after hardening, the hardened connecting material non-displaceably retains the planar component on the second shaped foil.

2. A method according to claim 1, wherein the step of affixing the first shaped foil to the subsurface further comprises:

applying a second hardenable connecting material to the subsurface, and pressing the shaped foil into the second hardenable connecting material, wherein the second hardening connecting material connects with the sub-surface and a form-fit connection is produced between the sub-surface and the shaped foil by the second hardened connecting material received in the grooves of the first shaped foil that face the sub-surface.

3. A method according to claim 2, wherein the first and the second shaped foils are formed such that their form-fit is detachable by elastically deforming and moving the second shaped foil away from the first shaped foil.

4. A method according to claim 1, wherein the first hardenable connecting material does not adhere to the shaped foils.

5. A method according to claim 1, wherein the planar component is a tile or a floor board and the sub-surface is a floor, wall, ceiling or an intermediate layer attached to the floor, wall or ceiling.

6. An apparatus for detachably affixing a planar component to a sub-surface, comprising:

a first shaped foil comprising a plurality of longitudinally-extending projections with longitudinally-extending grooves defined between peaks of adjacent projections such that the first shaped foil has an overall shape selected from the group consisting of substantially wave-shaped, substantially sinusoidal-shaped and substantially corrugated, wherein the internal lateral cross-section of at least one groove is defined such that, between a narrowed internal lateral cross-section and the bottom of the groove, an internal lateral cross-section that is wider than said narrowed internal lateral cross-section is provided, wherein a longitudinally-extending undercut is defined by said narrowed internal lateral cross-section, and wherein the longitudinally-extending projections and grooves are asymmetrical to the extent that the lateral width of said undercuts is smaller than the lateral cross-section of each projection at its widest point, and a second shaped foil having a shape that is the same, or substantially the same, as the first shaped foil that has been rotated by 180°, wherein widest lateral cross-sectional points of longitudinally-extending projections of the second shaped foil are arranged and constructed to interlock with the respective longitudinally extending undercuts of the grooves of the first shaped foil such that the second shaped foil is non-displaceably retained in the first shaped foil in at least one direction perpendicular to the longitudinally-extending grooves.

7. An apparatus according to claim 6, wherein the projections protrude by an amount (h) above said widest point of the projections that is less than the depth (t) of the grooves between said narrowed internal lateral cross-section and the bottom of the groove.

8. An apparatus according to claim 6, wherein the first and second shaped foils are formed such that, after being interlocked together, intermediate clearance spaces remain, respectively, between the bottom of each groove of the first shaped foil and the outer surface of the projection peak of the second shaped foil.

9. An apparatus according to claim 6, wherein the first and second shaped foils are formed such that the interlocked shaped foils are accommodated in each other deformation-free.

10. An apparatus according to claim 6, wherein the material of the first shaped foil is selected such that, when inserting the second shaped foil into the first shaped foil, the undercuts of the first shaped foil are elastically deformable so as to permit passage of the widest lateral point of projection past the undercut.

11. A system for detachably affixing a planar component to a sub-surface, comprising:

the apparatus of claim 6, and a hardenable connecting material, which is applicable to the planar component and/or the second shaped foil for connecting with the planar component in the hardened condition, wherein the hardened connecting material has the property of hardening so as to form a form-fit with the second shaped foil upon being at least partially received in the grooves of the second shaped foil and thereby being capable of retaining the planar component with respect to the second shaped foil.

12. A system according to claim 11, wherein the hardenable connecting material is not adherable to the first or second shaped foil.

13. A system according to claim 11, further comprising a connecting component having a surface formed with alternating projections and grooves, and a flat side, on which at least the deepest points of the grooves substantially abut.

14. A system according to claim 11, further comprising a connecting element having two rod elements configured to engage in the grooves of the first and second shaped foils, said rod elements being rigidly connected to each other at a right angles such their respective axes do not intersect.

15. A system according to claim 11, further comprising a spacer component having a spacer bridge, wherein projections that are insertable in the grooves protrude from the spacer bridge.

16. A system according to claim 11, further comprising a fastening element having a projection for engaging a groove of a component.

17. A system according to claim 11, further comprising a plug connector for the fist and second shaped foils having at least one receiving shaft for inserting a shaped foil, said receiving shaft being formed by an upper wall and a lower wall, wherein the upper wall, the lower wall and an insertion slot, which is formed between said walls, are configured to correspond to the shaped foils.

18. A system according to claim 11, further comprising a corner connector configured for connection of walls formed by folding the first or second shaped foil, said connector comprising wall segments arranged in accordance with the direction of the walls to be connected and comprising projections and grooves corresponding with those of the walls.

* * * * *